US005258273A

United States Patent [19]

Ezaki et al.

[11] Patent Number: 5,258,273

[45] Date of Patent: Nov. 2, 1993

[54] SILVER HALIDE COLOR PHOTOGRAPHIC LIGHT-SENSITIVE MATERIAL

[75] Inventors: Atsuo Ezaki; Katsutoyo Suzuki; Hiroshi Ikeda, all of Hino, Japan

[73] Assignee: Konica Corporation, Tokyo, Japan

[21] Appl. No.: 754,385

[22] Filed: Sep. 3, 1991

[30] Foreign Application Priority Data

Sep. 4, 1990 [JP] Japan ..... 2-234209

[51] Int. Cl.[5] ..... G03C 1/08

[52] U.S. Cl. ..... 430/509; 430/506; 430/505; 430/553; 430/588

[58] Field of Search ..... 430/509, 506, 505, 553, 430/588

[56] References Cited

U.S. PATENT DOCUMENTS

| | | | |
|---|---|---|---|
| 4,028,115 | 6/1977 | Hinata et al. | 96/124 |
| 4,663,271 | 5/1987 | Nozawa et al. | 430/503 |
| 4,670,375 | 6/1987 | Michiue et al. | 430/509 |
| 4,880,726 | 11/1989 | Shiba et al. | 430/376 |
| 5,034,310 | 7/1991 | Ikeda et al. | 430/506 |

FOREIGN PATENT DOCUMENTS

| | | | |
|---|---|---|---|
| 317826 | 5/1989 | European Pat. Off. . | |
| 3238448 | 10/1991 | Japan | 430/506 |

*Primary Examiner*—Charles L. Bowers, Jr.
*Assistant Examiner*—Geraldine Letscher
*Attorney, Agent, or Firm*—Jordan B. Bierman

[57] ABSTRACT

A silver halide color photographic light-sensitive material is disclosed. The light-sensitive material comprises a support, having thereon a red sensitive silver halide emulsion layer, a green-sensitive silver halide emulsion layer and a blue-sensitive silver halide emulsion layer, wherein the red-sensitive comprises a low-speed red-sensitive silver halide emulsion sublayer, a medium-seed red-sensitive silver halide emulsion sublayer and a high-speed red-sensitive silver halide emulsion layer provided in this order from the support, and sensitivities $S_{600}$, $S_{620}$, $S_{640}$, $S_{660}$ and $S_{680}$ of the medium speed red-sensitive emulsion sublayer which are each determined as reciprocal of the exposure amount of light of wavelength of 600 nm, 620 nm, 640 nm, 660 nm and 680 nm necessary for forming an image having a density of fog+0.1 in the medium speed red-sensitive emulsion sublayer, respectively, satisfy the following relation;

$$0.5S_{640} < S_{600} < 0.9S_{640},$$

$$0.7S_{640} < S_{620} < 1.2S_{640},$$

$$0.4S_{640} < S_{660} < 0.9S_{640} \text{ and}$$

$$S_{680} \leqq 0.4S_{640}, \text{ and}$$

sensitivities, $S_R$ and $S_G$, of the red-sensitive emulsion layer and the green-sensitive emulsion layer to a specific red light has the following relation;

$$S_G < 0.35S_R.$$

7 Claims, 1 Drawing Sheet

SILVER HALIDE COLOR PHOTOGRAPHIC LIGHT-SENSITIVE MATERIAL

FIELD OF THE INVENTION

The present invention relates to a silver halide color photographic light-sensitive material, and more particularly to a silver halide color photographic light-sensitive material capable of forming a highly colorful and well-color-reproduced image even when used to photograph a subject under fluorescent lamp lighting conditions.

BACKGROUND OF THE INVENTION

Recent silver halide color photographic light-sensitive material products are so improved as to form remarkably high-quality images. The three major elements of an image quality — graininess, sharpness and color reproducibility — are all on a considerably high level, so that most customers appear to be contented with their prints or slide photos reproduced.

However, of the above three major elements, regarding the color reproducibility, a certain color that is conventionally said hard to be reproduced in a photograph still now remains unchanged although its color purity is improved.

That is, there are many problems yet to be solved in the color reproducibility. For example, purple, bluish purple, which reflect lights having longer wavelengths than 600 nm, or greenish colors, such as bluish green and yellowish green, tend to be reproduced into colors quite different from the actual colors, which may disappoint customers.

Therefore, there has been a strong demand for improving the above problem. The major factors of the color reproducibility in conventional techniques are the spectral sensitivity distribution and interimage effect.

It is conventionally known that the interimage effect can be attained by adding to a silver halide multilayer color photographic light-sensitive material a compound called DIR compound capable of releasing a development inhibitor or a precursor thereof upon its coupling reaction with a color developing agent, wherein the development inhibitor inhibits the development of different color-forming layers to thereby create an interimage effect for color reproducibility improvement.

In a color negative film, it is also possible to make an effect similar to the interimage effect by using a colored coupler in a larger amount than is necessary to cancel a useless absorption.

However, the use of an excessive amount of a colored coupler causes the minimum density of the film to increase, which makes it very difficult to judge the color density correction in making prints, sometimes resulting in an inferior color quality of finished prints. The above techniques chiefly contribute to improvement of color purity, rather than the color reproducibility.

On the other hand, as for the spectral sensitivity distribution, U.S. Pat. No. 3,672,898 discloses a proper spectral sensitivity distribution for reducing the variation of the color reproducibility by different light sources used in photographing.

This, however, is not a means for correcting the aforementioned wrong color reproduction. There is also disclosed a spectral distribution/interimage effect combination technique; for example, JP O.P.I. No. 034541/1986 makes an attempt to improve the foregoing color film's reproduction of certain colors hard to be reproduced, and its effect appears to have been obtained to some extent. The attempt is to exert not only the respective effects of the conventional blue-sensitive layer, green-sensitive layer and red-sensitive layer but also the interimage effect from the outside of the wavelengths to which the above color-sensitive layers are sensitive.

The above technique is considered useful to a certain extent for improving the reproducibility of specific colors, but the technique, for interimage effect generation, needs an interimage effect-generating layer and a light-sensitive silver halide layer in addition to the conventional blue-sensitive green-sensitive and red-sensitive emulsion layers, which requires increasing the amount of silver and the number of production processes to thus result in a high production cost. Besides, its effect is not sufficient.

The foregoing U.S. Pat. No. 3,672,898, discloses a spectral sensitivity distribution for reducing the color reproducibility variation due to different light sources used in photographing; this intends to reduce the color variation by bringing the spectral sensitivity distributions of the blue-sensitive and red-sensitive layers close to that of the green-sensitive layer to thereby lessen the changes in the sensitivities of these layers corresponding to different light sources, particularly different color temperatures, in photographing. In this instance, the three color-sensitive layers are so close to one another as to overlap their spectral sensitivity distributions to cause a color purity deterioration. The color purity deterioration can be prevented to a certain extent, as is well known, by emphasizing the interimage effect by use of the foregoing diffusible DIR compound. However, it has been found that even any combination of the above techniques is unable to render any satisfactory color reproduction to the recently prevailing photographing under fluorescent lamp lighting conditions.

SUMMARY OF THE INVENTION

It is an object of the invention to provide a silver halide color photographic light-sensitive material capable of truly reproducing bluish purple and green colors and making it possible to obtain color images in non-greenish normal colors in photographing even under fluorescent-lighting conditions.

The above object is accomplished by a silver halide color photographic light-sensitive material comprising a support having thereon a red-sensitive silver halide emulsion layer, a green-sensitive silver halide emulsion layer and a blue-sensitive silver halide emulsion layer, in which the red-sensitive silver halide emulsion layer is of a three-layer structure comprised of a low-speed red-sensitive silver halide emulsion sublayer, a medium-speed red-sensitive silver halide emulsion sublayer and a high-speed red-sensitive silver halide emulsion sublayer in the described order from the support side, wherein if the reciprocal of the exposure amount at 640 nm giving the fog(Dmin)+0.1 density of the medium-speed red-sensitive silver halide emulsion sublayer is denoted by a sensitivity of $S_{640}$, then the sensitivity of $S_{600}$ at 600 nm giving the fog(Dmin)+0.1 density has a relation of $$0.5\ S_{640} < S_{600} < 0.9\ S_{640},$$

the sensitivity of $S_{620}$ at 620 nm giving the fog(Dmin)+0.1 density has a relation of $0.7S_{640} < S_{620} < 1.2S_{640}$, the sensitivity of $S_{660}$ at 660nm giving the fog(D-min)+0.1 density has a relation of $0.4S_{640} < S_{660} < 0.9S_{640}$, and the sensitivity of $S_{680}$ at 680nm giving the fog(D-min)+0.1 density has a relation of $S_{680} \leqq 0.4S_{640}$, and if the specific red-sensitivities of the red-sensitive silver halide emulsion layer and the green-sensitive silver halide emulsion layer are denoted by $S_R$ and $S_G$, respectively, they have a relation of $S_G < 0.35S_R$.

DETAILED DESCRIPTION OF THE INVENTION

Figure 1:
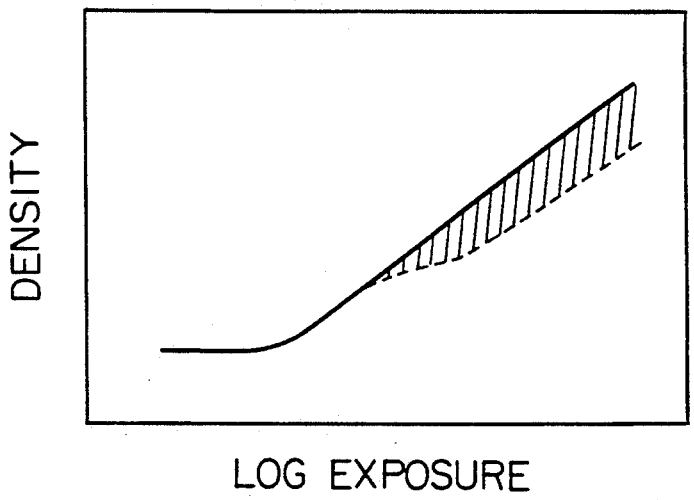
FIG. 1 shows characteristic curves of a multilayer light-sensitive material sample, in which the solid-line characteristic curve is of its red-sensitive layer's medium-speed sublayer containing a coupler, while the dotted-line characteristic curve is of the same medium-speed sublayer having the coupler and silver halide removed therefrom and instead containing a compound C-3.

The sensitivity at a specific wavelength in the invention is determined according to the following experiment method.

Preparation of Sample

A silver halide photographic light-sensitive material sample comprising a support having thereon a single layer of the following composition is prepared. The adding amount of each of the following components is shown in grams per $m^2$ except that the amount of silver halide is in silver equivalent.

| | |
|---|---|
| Silver halide | 1.0 g |
| Cyan coupler C-1 | 0.70 g |
| Colored cyan coupler CC-1 | 0.066 g |
| DIR compound DC-3 | 0.04 g |
| High-boiling solvent Oil-1 | 0.64 g |
| Gelatin | 4.0 g |

In addition to the above components, coating aid Su-1, dispersing aid Su-2 and Hardener H-1 are added.

Exposure, Processing

The above sample is subjected to 1/100 sec. exposure to a white light through an optical wedge with interference filters KL-59 to KL-70, manufactured by Toshiba Glass Co.. and then subjected to the following processing (A), wherein each interference filter is one actually measured for its peak wavelength and transmittance beforehand with a Spectrophotometer 320, manufactured by Hitachi Ltd. (Table 1).

| Processing A (38° C.) | |
|---|---|
| Color developing | 1 min. 45 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions used in the above processing steps are as follows:

| | |
|---|---|
| Color developer | |
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrate | 2.5 g |
| Potassium hydroxide | 1.0 g |
| Water to make 1 liter (pH = 10.1) | |
| Bleaching bath | |
| Ferric-ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Water to make 1 liter. | |
| Adjust pH to 6.0 with ammonia water. | |
| Fixing bath | |
| Ammonium thiosulfate | 175.0 g |
| Anhydrous sodium sulfite | 8.5 g |
| Sodium metabisulfite | 2.3 g |
| Water to make 1 liter. | |
| Adjust pH to 6.0 with acetic acid. | |
| Stabilizing bath | |
| Formalin (37% solution) | 1.5 ml |
| Koniducks (produced by KONICA Corp.) | 7.5 ml |
| Water to make 1 liter. | |

TABLE 1

| Filter | λ(nm) | Rel. transmittance* |
|---|---|---|
| KL-59 | 587.0 | 0.974 |
| KL-60 | 598.0 | 0.962 |
| KL-61 | 606.5 | 1.188 |
| KL-62 | 616.5 | 1.011 |
| KL-63 | 625.5 | 0.768 |
| KL-64 | 635.0 | 1.000 |
| KL-65 | 647.0 | 0.813 |
| KL-66 | 660.0 | 1.093 |
| KL-67 | 668.0 | 0.860 |
| KL-68 | 675.0 | 0.841 |
| KL-69 | 687.0 | 1.308 |
| KL-70 | 695.0 | 0.741 |

*Relative value to the KL-64's transmittance set at 1.000

The density of the exposed-through-wedge area of each processed sample is measured, the reciprocal of the exposure amount (sensitivity) giving the fog +0.1 density is compensated by the in advance measured transmittance of each filter, and the compensated value is found for each exposure wavelength to thereby obtain a spectral sensitivity distribution.

If the sensitivity value at 640 nm is denoted by $S_{640}$, and the values at 600 nm, 620nm, 660 nm and 680 nm by $S_{600}$, $S_{620}$, $S_{660}$ and $S_{680}$, respectively, the sensitivity distribution ranges are as described in the claim of the invention, and preferably $0.6S_{640} < S_{600} < 0.8S_{640}$, $0.8S_{640} < S_{620} < 1.1S_{640}$, $0.5S_{640} < S_{660} < 0.7S_{640}$, and $0.05S_{640} < S_{680} < 0.3S_{640}$.

The spectral sensitivity distribution of the medium speed red-sensitive emulsion sublayer of the invention can be obtained by the combined use of at least one of the sensitizing dyes represented by the following Formula I and at least one of the sensitizing dyes represented by the following Formula III, and preferably by the combined use of at least one of the sensitizing dyes of Formula I, at least one of the sensitizing dyes of Formula II and at least one of the sensitizing dyes of Formula III.

A supersensitizer may also be used in addition to the sensitizing dyes of Formulas I, II and III. As the supersensitizer there may be used the benzothiazoles and quinones described in JP E.P. No. 24533/1982, and the quinoline derivatives described in JP E.P. No. 24899/1982.

Formulas I, II and III are explained below:

Formula I

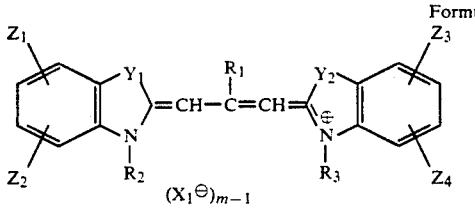

wherein $R_1$ represents a hydrogen atom, an alkyl group or an aryl group; $R_2$ and $R_3$ each represent an alkyl group; $Y_1$ and $Y_2$ each represent a sulfur atom or a selenium atom; $Z_1$, $Z_2$, $Z_3$ and $Z_4$ each represent a hydrogen atom, a halogen atom, a hydroxyl group, an alkoxy group, an amino group, an acyl group, an acylamino group, an acyloxy group, an aryloxy group, an alkoxycarbonyl group, an aryloxycarbonyl group, an alkoxycarbonylamino group, a sulfonyl group, a carbamoyl group, an aryl group, an alkyl group, or a cyano group, provided that $Z_1$ and $Z_2$ and/or $Z_3$ and $Z_4$ may combine with each other to form a ring; $X_1\ominus$ is an anion; and m is an integer of 1 to 2, provided that m represents 1 when the sensitizing dye forms an intramolecular salt.

Formula II

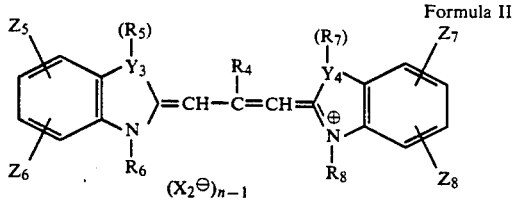

wherein $R_4$ represents a hydrogen atom, an alkyl group or an aryl group; $R_5$, $R_6$, $R_7$ and $R_8$ each represent an alkyl group; $Y_3$ and $Y_4$ each represent a nitrogen atom, an oxygen atom, a sulfur atom or a selenium atom, provided that $Y_3$ and $Y_4$, when each representing a sulfur, oxygen or selenium atom, do not have the above $R_5$ or $R_7$, and can not be nitrogen atoms at the same time; $Z_5$, $Z_6$, $Z_7$ and $Z_8$ each represent a hydrogen atom, a halogen atom, a hydroxyl group, an alkoxy group, an amino group, an acylamino group, an acyloxy group, a aryloxy group, an alkoxycarbonyl group, an aryloxycarbonyl group, an alkoxycarbonylamino group, a carbamoyl group, an aryl group, an alkyl group, a cyano group or a sulfonyl group, provided that $A_5$ and $Z_6$ and/or $Z_6$ and $Z_8$ may combine with each other to form a ring; $X_2\ominus$ represents an anion; and n is an integer or 1 or 2, provided that n is 1 when the sensitizing dye forms an intramolecular salt.

Formula III

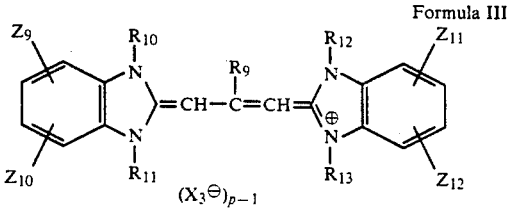

wherein $R_9$ represents a hydrogen atom, an alkyl group or an aryl group; $R_{10}$, $R_{11}$, $R_{12}$ and $R_{13}$ each represent an alkyl group; $Z_9$, $Z_{10}$, $Z_{11}$ and $Z_{12}$ each represent a hydrogen atom, a halogen atom, a hydroxyl group, an alkoxy group, an amino group, an acyl group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group, provided that $Z_9$ and $Z_{10}$ and/or $Z_{11}$ and $Z_{12}$ may combine with each other to form a ring; $X_3\ominus$ is an anion; and p is an integer of 1 or 2, provided that p is 1 when the sensitizing dye forms an intramolecular salt.

Exemplified compounds

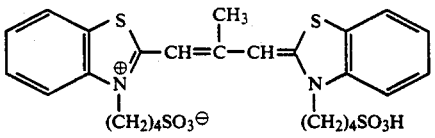

(I-1)

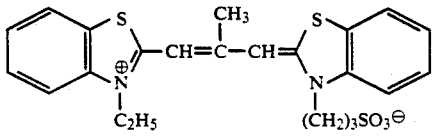

(I-2)

-continued
Exemplified compounds
(I-3)
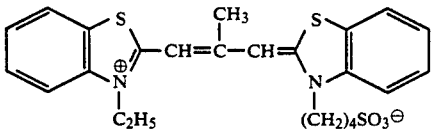
(I-4)
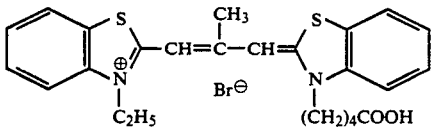
(I-5)
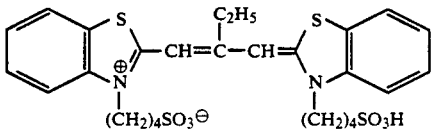
(I-6)
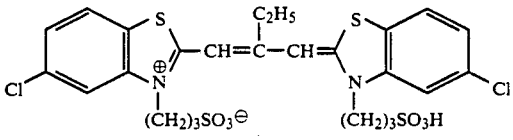
(I-7)
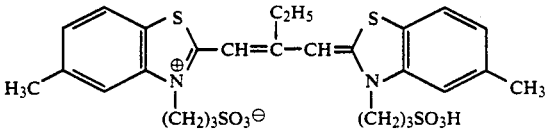
(I-8)
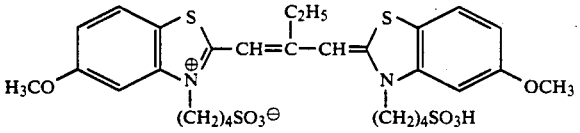
(I-9)
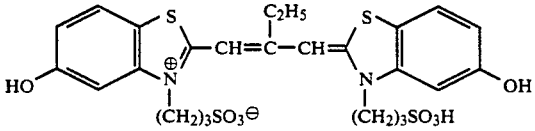
(I-10)
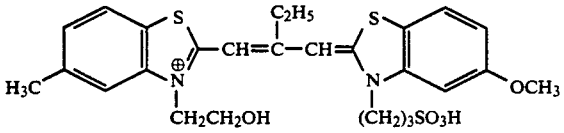
(I-11)
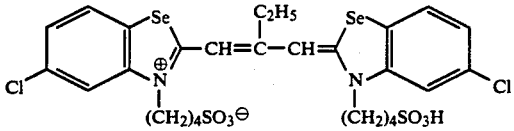
(I-12)
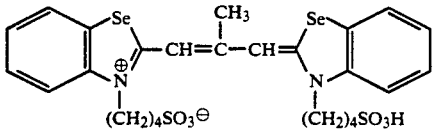

-continued
Exemplified compounds
(I-13)
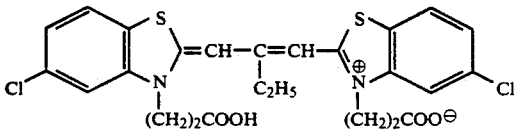
(I-14)
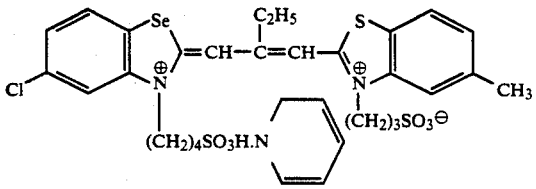
(I-15)
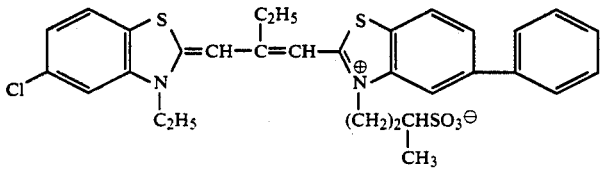
(I-16)
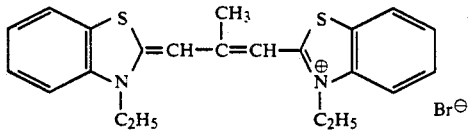
(I-17)
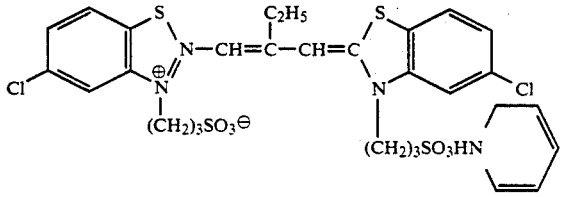
(I-18)
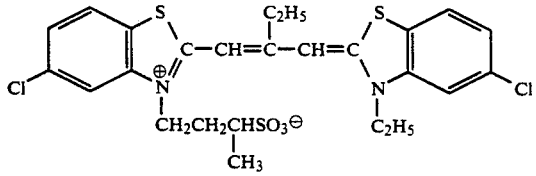
(I-19)
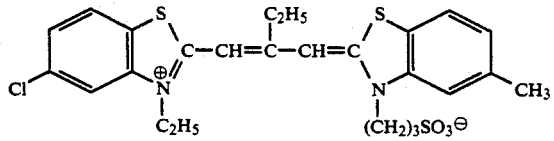
(I-20)
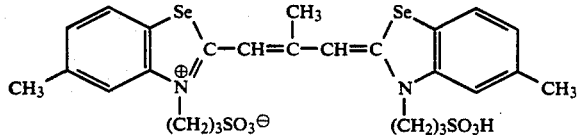
(I-21)
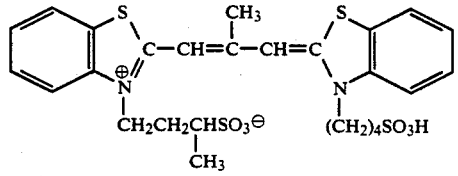

-continued
Exemplified compounds
(I-22)
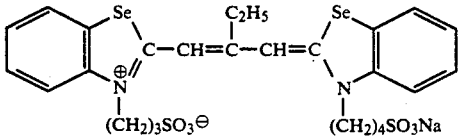
(I-23)
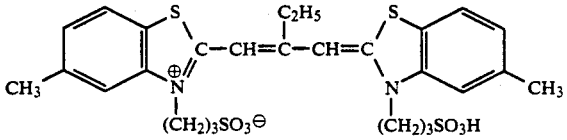
(I-24)
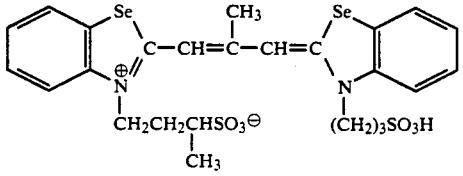
(I-25)
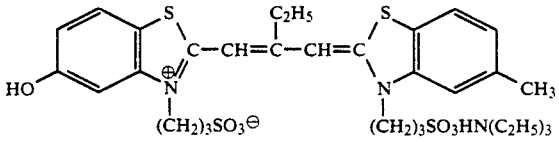
(I-26)
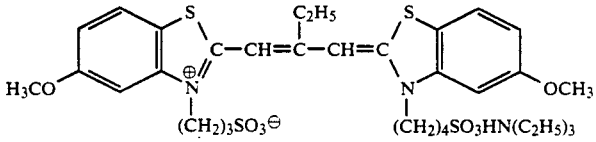
(I-27)
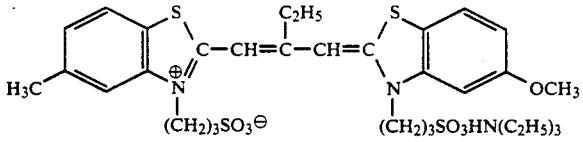
(I-28)
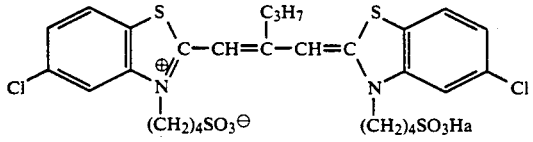
(I-29)
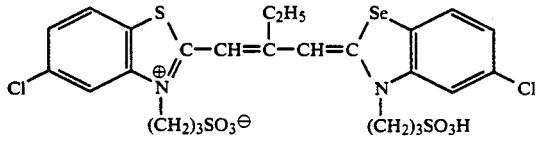
(I-30)
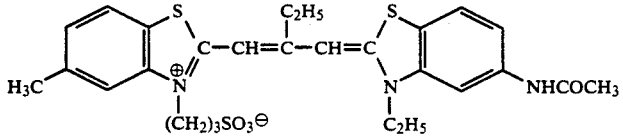
(I-31)
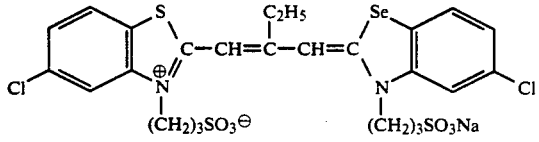

-continued
Exemplified compounds
(I-32)
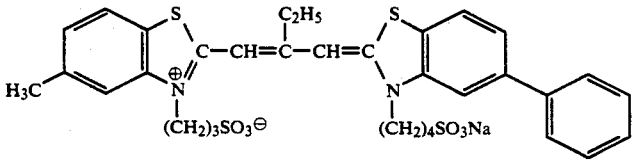
(I-33)
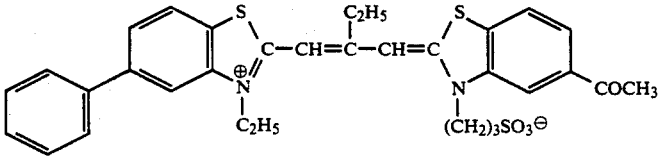
(I-34)
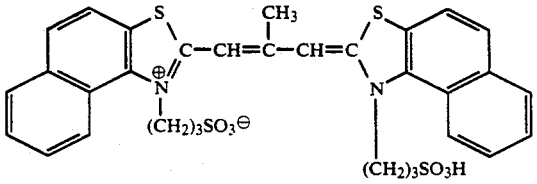
(I-35)
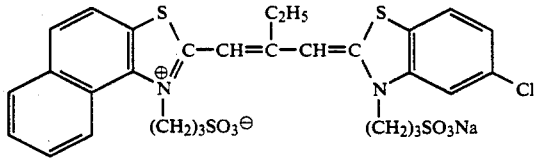
(I-36)
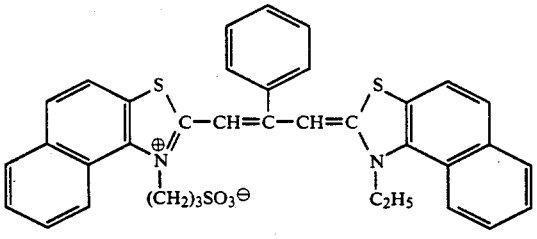
(I-37)
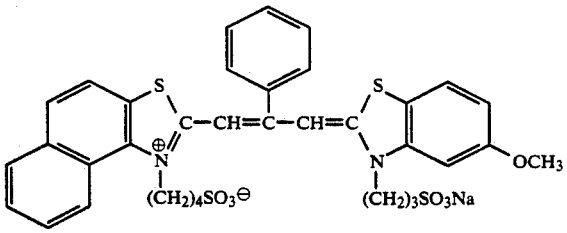
(I-38)
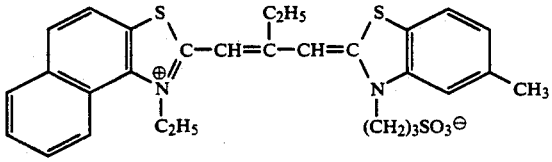
(I-39)
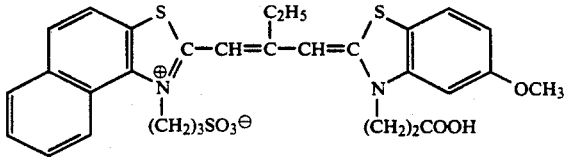

-continued
Exemplified compounds
(I-40)
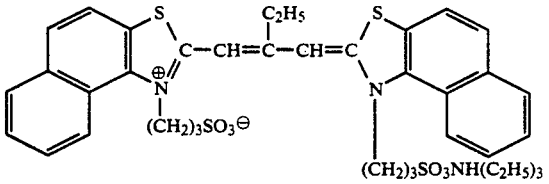
(I-41)
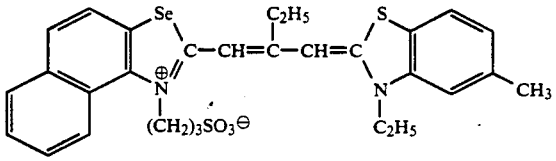
(I-42)
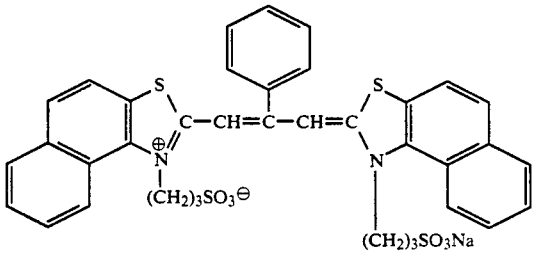
(I-43)
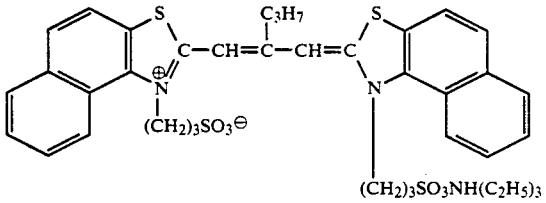
(I-44)
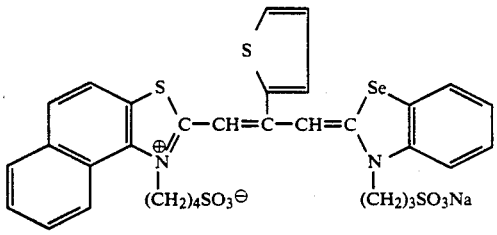
(I-45)
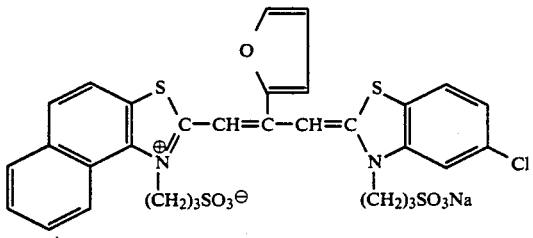
(I-46)
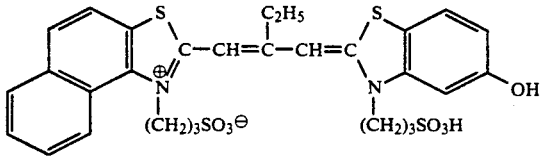

-continued
Exemplified compounds
(II-1)
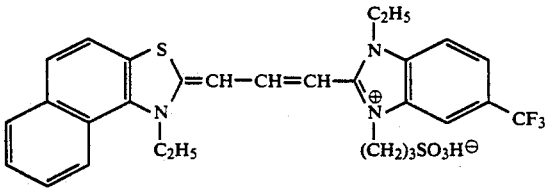
(II-2)
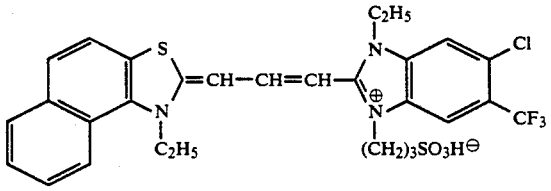
(II-3)
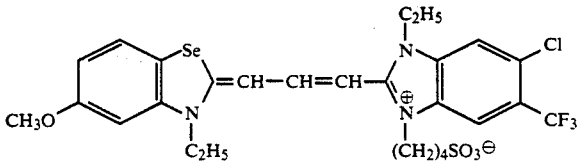
(II-4)
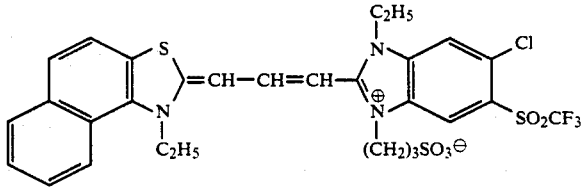
(II-5)
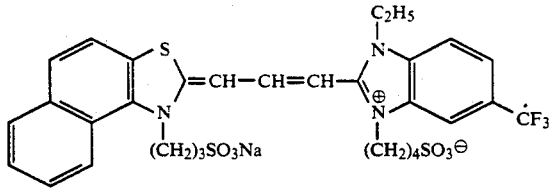
(II-6)
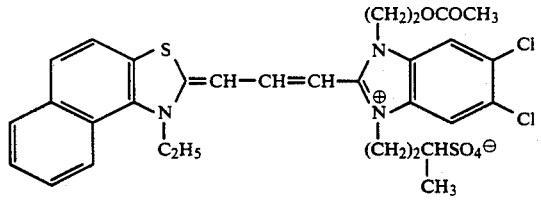
(II-7)
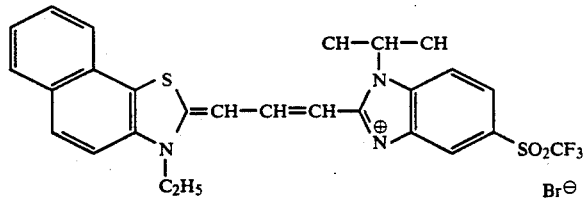
(II-8)
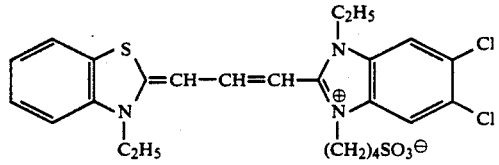

-continued
Exemplified compounds
(II-9)
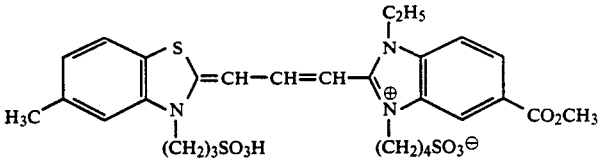
(II-10)
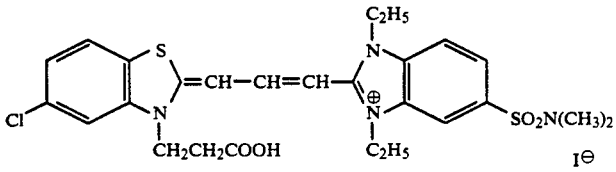
(II-11)
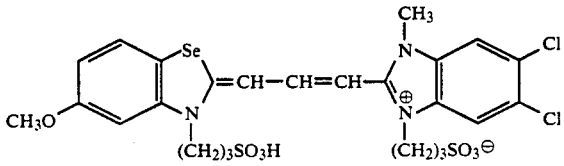
(II-12)
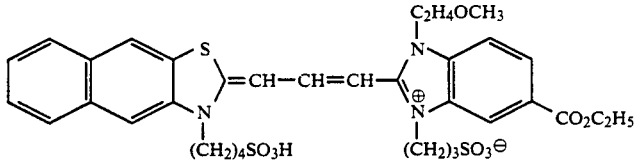
(II-13)
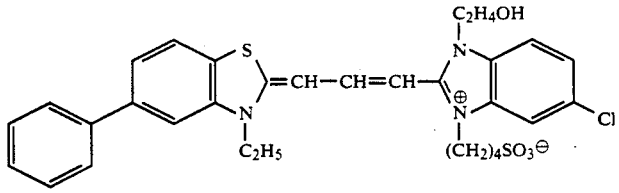
(II-14)
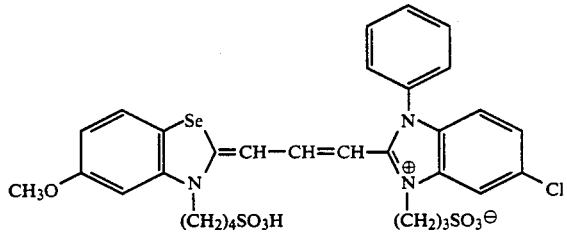
(II-15)
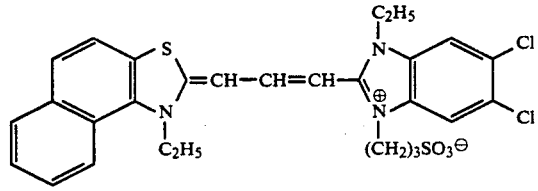
(II-16)
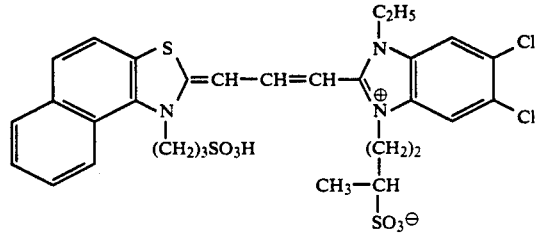

-continued
Exemplified compounds
(II-17)
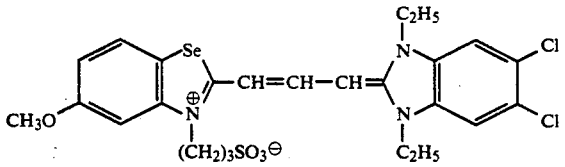
(II-18)
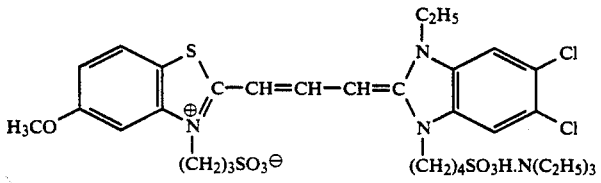
(II-19)
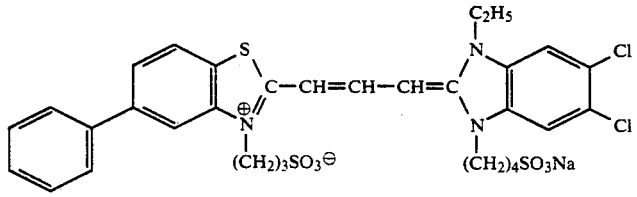
(II-20)
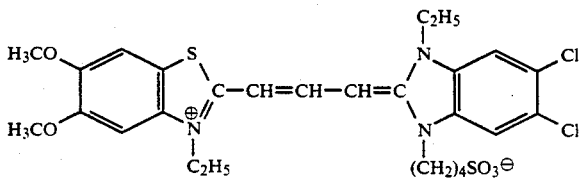
(II-21)
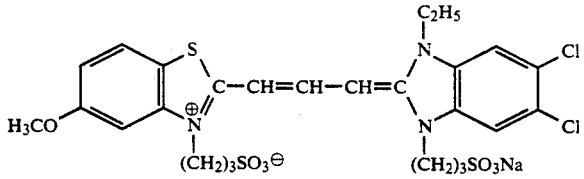
(II-22)
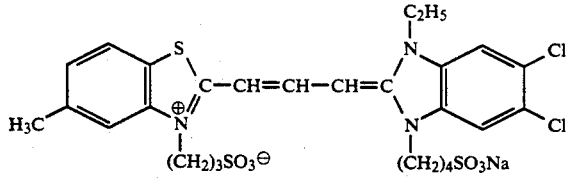
(II-23)
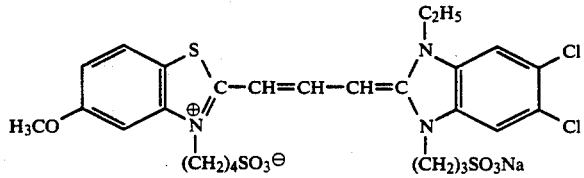
(II-24)
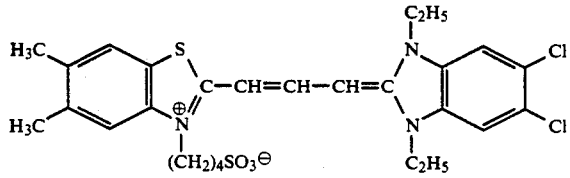

-continued
Exemplified compounds
(II-25)
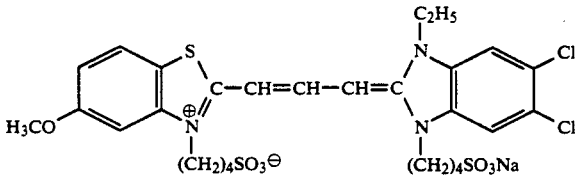
(II-26)
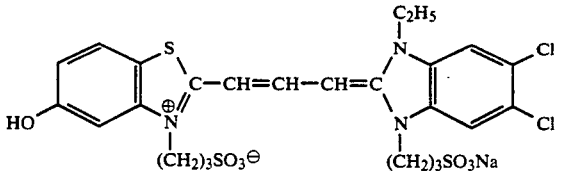
(II-27)
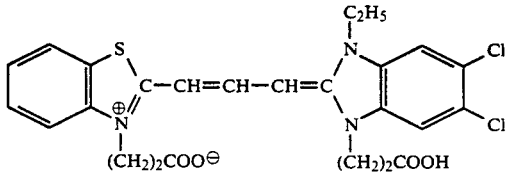
(II-28)
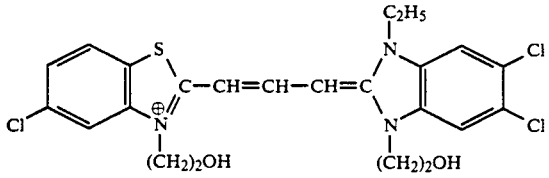
(II-29)
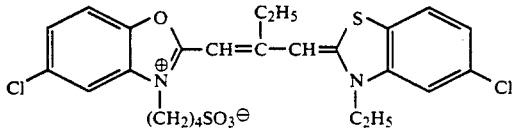
(II-30)
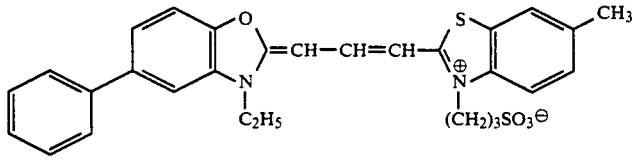
(II-31)
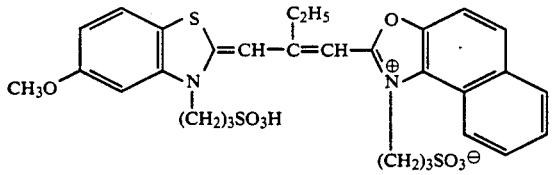
(II-32)
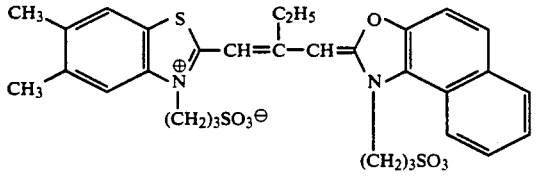
(II-33)
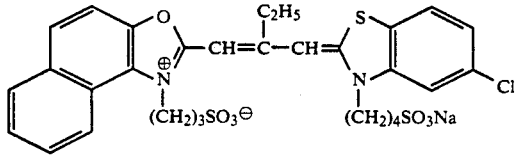

-continued
Exemplified compounds
(II-34)
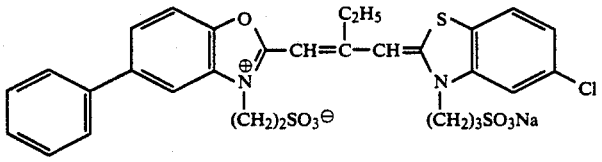
(II-35)
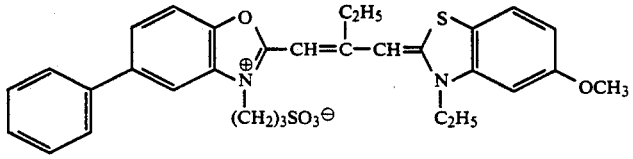
(II-36)
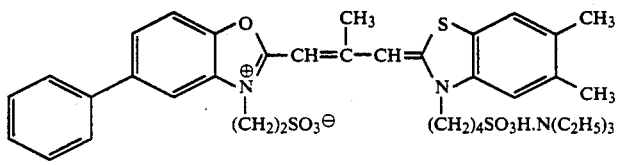
(II-37)
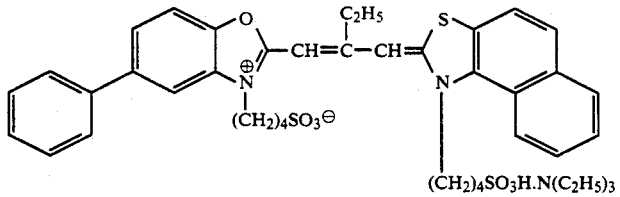
(II-38)
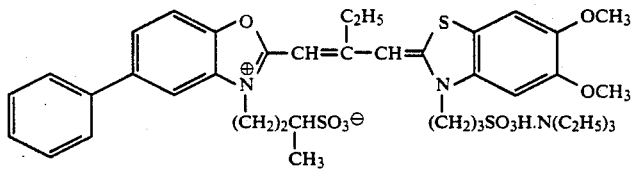
(II-39)
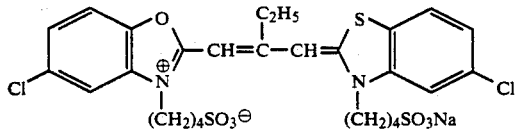
(II-40)
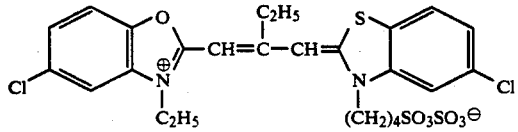
(III-1)
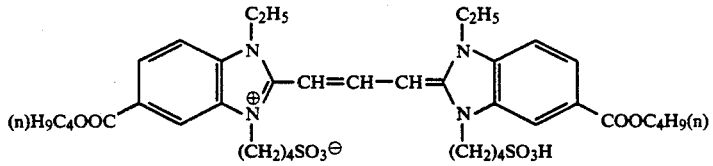
(III-2)
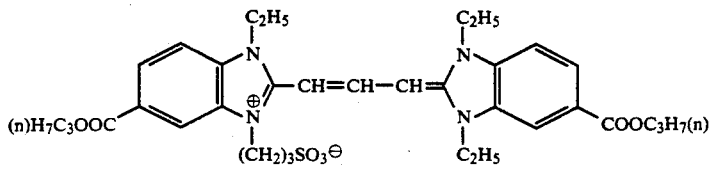

-continued
Exemplified compounds
(III-3)
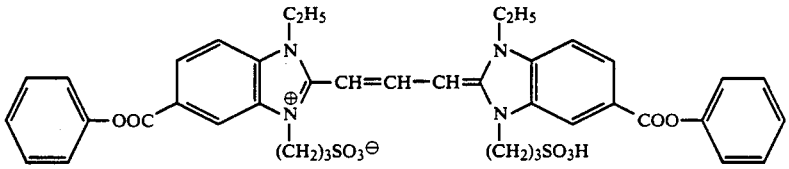
(III-4)
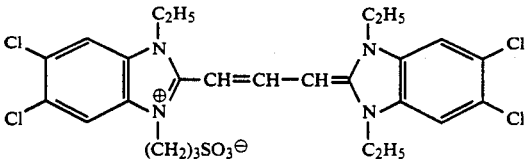
(III-5)
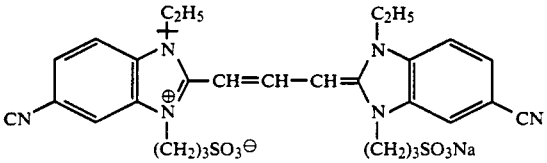
(III-6)
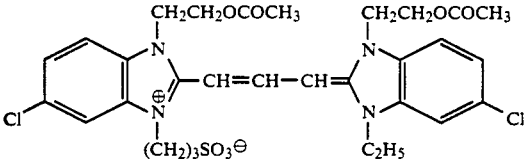
(III-7)
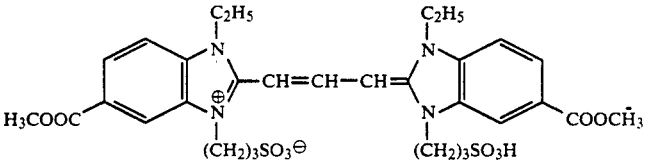
(III-8)
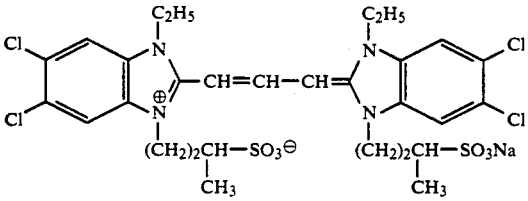
(III-9)
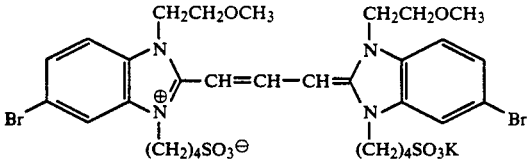
(III-10)
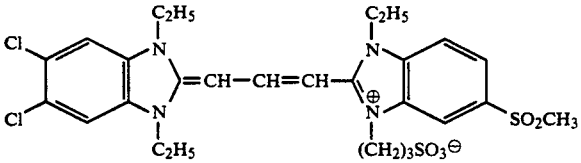
(III-11)
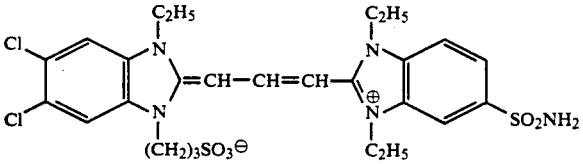

-continued
Exemplified compounds
(III-12)
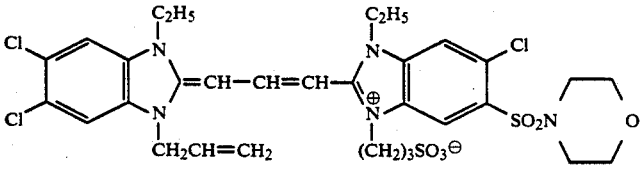
(III-13)
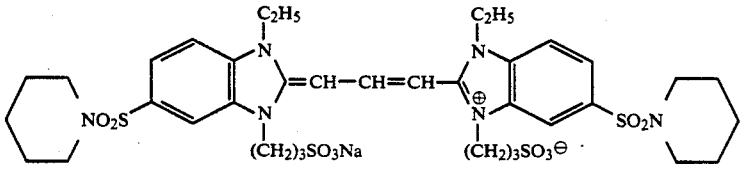
(III-14)
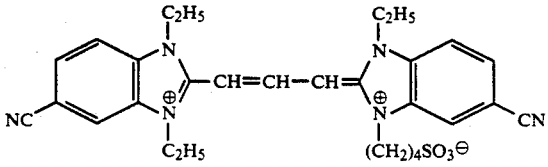
(III-15)
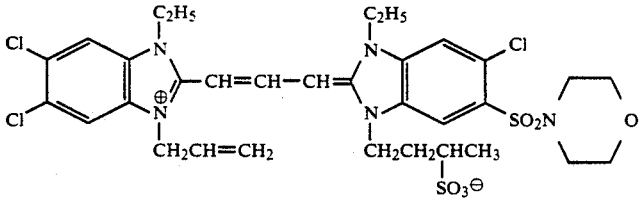
(III-16)
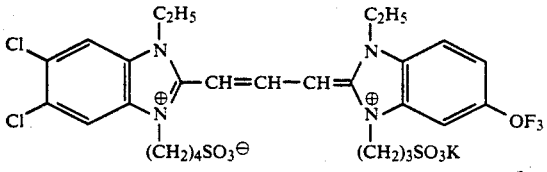
(III-17)
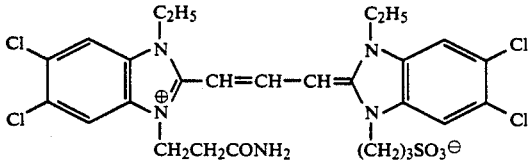
(III-18)
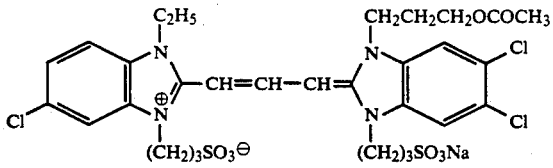
(III-19)
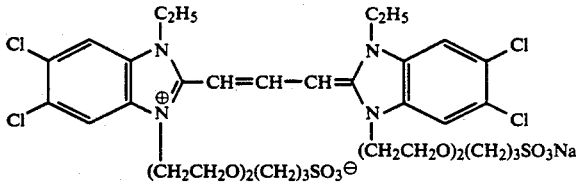
(III-20)
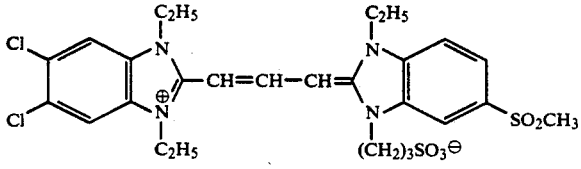

-continued
Exemplified compounds
(III-21)
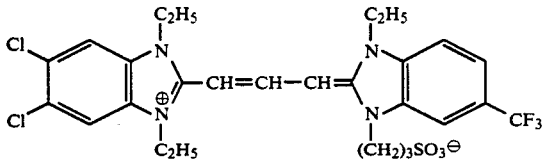
(III-22)
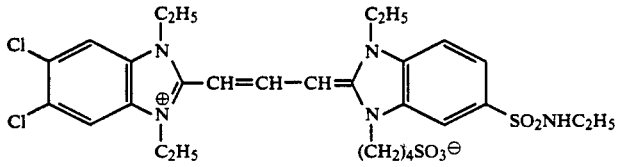
(III-23)
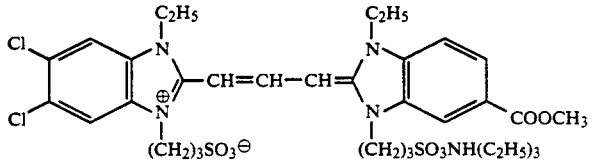
(III-24)
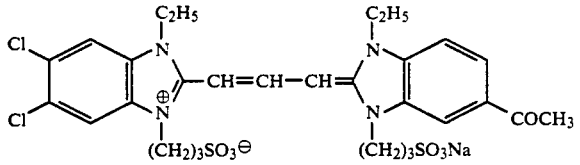
(III-25)
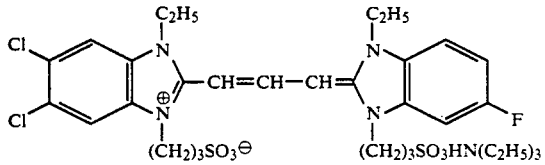
(III-26)
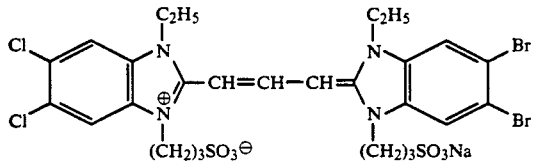
(III-27)
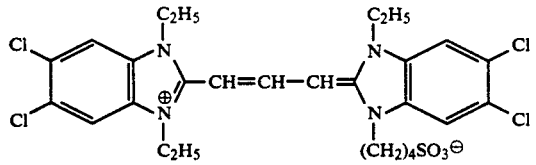
(III-28)
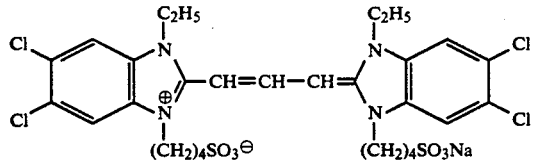
(III-29)
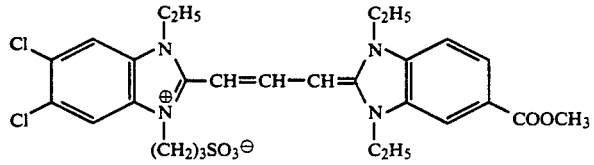

-continued

Exemplified compounds

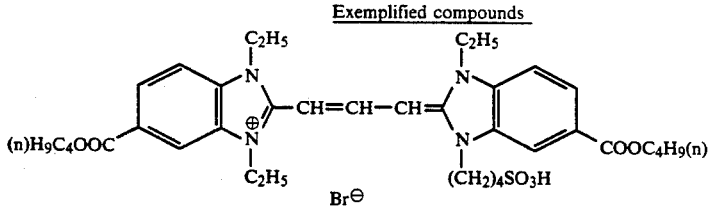

(III-30)

In the invention, the specific red sensitivities $S_R$ and $S_G$ of a color light-sensitive material are obtained in accordance with the following method. Firstly, a photographic characteristic density curve is prepared by the following method.

The characteristic curve or D-(log E) curve herein is a curve showing the relation between a formed color density D and the logarithm of an exposure amount, which in the invention is determined according to the following test method.

(1) Test Conditions

The test is performed in a room maintained at a temperature of 20+5° C. and a relative humidity of 60+10%. A light-sensitive material test sample is allowed to stand for more than an hour under the above atmospheric conditions, and then tested according to the following procedure.

(2) Exposure a. The relative spectral energy distribution of the light for exposure at the surface of a sample to be exposed is shown in Table 1.

TABLE 1

| Wavelength nm | Relative spectral energy* | Wavelength nm | Relative spectral energy* |
|---|---|---|---|
| 360 | 2 | 540 | 102 |
| 370 | 8 | 550 | 103 |
| 380 | 14 | 560 | 100 |
| 390 | 23 | 570 | 97 |
| 400 | 45 | 580 | 98 |
| 410 | 57 | 590 | 90 |
| 420 | 63 | 600 | 93 |
| 430 | 62 | 610 | 94 |
| 440 | 31 | 620 | 92 |
| 450 | 93 | 630 | 88 |
| 460 | 97 | 640 | 89 |
| 470 | 98 | 650 | 86 |
| 480 | 101 | 660 | 86 |
| 490 | 97 | 670 | 89 |
| 500 | 100 | 680 | 85 |
| 510 | 101 | 690 | 75 |
| 520 | 100 | 700 | 77 |
| 530 | 104 | | |

Note: *Value relative to 560 nm Set at 100.

b. The changes in the illuminance at the exposure plane are carried out by use of an optical wedge. The optical wedge used, in any part thereof, has a spectral transmission density variation of within 10% in the region of 360 nm to 400 nm, and within 5% in the region of 400 nm to 700 nm.

c. A color compensating filter CC-90R, manufactured by Eastman Kodak Company, is placed between a light source having the above relative spectral energy and the above sample to thereby convert the light from the light source into a red light.

d. Exposure time is 1/100 second.

(3) Processing a. During the period of time between the exposure and the processing, the test sample is kept in an atmoeshere maintained at a temperature of 20+5° C. with a relative humidity of 60+10%.

b. The processing is completed within the time range of 30 minutes to 6 hours after the exposure.

c. The processing is performed as follows:

| Processing B | | |
|---|---|---|
| Color processing | 38.0 ± 0.1° C. | 3 min. 15 Sec. |
| Bleaching | 38.0 ± 3.0° C. | 6 min. 30 sec. |
| Washing | 24 – 41° C. | 3 min. 15 sec. |
| Fixing | 38.0 ± 3.0° C. | 6 min. 30 sec. |
| Washing | 24 – 41° C. | 3 min. 15 sec. |
| Stabilizing | 38.0 ± 3.0° C. | 3 min. 15 sec. |
| Drying | less than 50° C. | |

The compositions of the processing solutions used above are the same as those used in the foregoing Processing A.

(4) Densitometry

The density is denoted by $\log_{10}(\phi_0/\phi)$, wherein $\phi_0$ is an incident light flux for density measurement, while $\phi$ is a transmittedlight flux through a measuring area of a sample. The geometric condition of the densitometry is such that the incident light is a parallel light flux in the normal direction and passes through a sample to become a transmitted light extended over a half space. The overall extended light flux is used as a rule for the measurement. Where a measuring method other than the above method is used, it is necessary to use a standard density piece for compensation. At the time of the measurement, the emulsion plane of the light-sensitive material is set so as to face the light receptor of a densitometer. The densitometry is conducted with a light of which the spectral characteristics as composite characteristics of the light source, optical system, optical filter and receptor of the densitometer used are shown in terms of blue, green and red status M density values in Table 2.

TABLE 2

Spectral characteristics in terms of status M densities (In logarithm: relative values to the peak set at 5.00)

| Wavelength nm | Blue | Green | Red |
|---|---|---|---|
| 400 | * | | |
| 410 | 2.10 | | |
| 420 | 4.11 | | |
| 430 | 4.63 | * | |
| 440 | 4.37 | | |
| 450 | 5.00 | | * |
| 460 | 4.95 | | |
| 470 | 4.74 | 1.13 | |
| 480 | 4.34 | 2.19 | |
| 490 | 3.74 | 3.14 | |
| 500 | 2.99 | 3.79 | |

TABLE 2-continued

| Spectral characteristics in terms of status M densities (In logarithm: relative values to the peak set at 5.00) | | | |
|---|---|---|---|
| Wavelength nm | Blue | Green | Red |
| 510 | 1.35 | 4.25 | \| |
| 520 | \| | 4.61 | \| |
| 530 | \| | 4.85 | \| |
| 540 | \| | 4.98 | \| |
| 550 | \| | 4.98 | \| |
| 560 | \| | 4.80 | \| |
| 570 | \| | 4.44 | \| |
| 580 | \| | 3.90 | \| |
| 590 | \| | 3.15 | \| |
| 600 | \| | 2.22 | \| |
| 610 | \| | 1.05 | \| |
| 620 | \| | \| | 2.11 |
| 630 | ** | \| | 4.48 |
| 640 | \| | \| | 5.00 |
| 650 | \| | ** | 4.90 |
| 660 | \| | \| | 4.58 |
| 670 | \| | \| | 4.25 |
| 680 | \| | \| | 3.88 |
| 690 | \| | \| | 3.45 |
| 700 | \| | \| | 3.10 |
| 710 | \| | \| | 2.69 |
| 720 | \| | \| | 2.27 |
| 730 | \| | \| | 1.86 |
| 740 | \| | \| | 1.45 |
| 750 | \| | \| | 1.05 |

Note:
Slope of red . . . 0.260/nm, Slope of green . . . 0.106/nm, Slope of blue . . . 0.250/nm.
**Slope of red . . . 0.040/nm, Slope of green . . . 0.120/nm, Slope of blue . . . 0.220/nm.

The yellow, magenta and cyan densities obtained by measurement the above exposed and processed sample are plotted for common logarithmic values of the exposure amounts (log E) to thereby determine a photographic characteristic curve D−(log E).

From the thus obtained characteristic curve, the exposure amounts $E_G$ and $E_R$, respectively, to give the minimum magenta density Dmin(M)+0.1 and the minimum cyan density Dmin(C)+0.1 are determined, and the $S_G$ and $S_R$ are calculated as reciprocal of the $E_G$ and $E_R$, respectively. In the invention, $S_G$ and $S_R$ are required to have the following relation:

$$S_G<0.35S_R$$

In the invention, the maximum formed color density of the medium-speed sublayer of the red-sensitive layer, when determined in the following manner, is preferably not more than 0.35, and more preferably not more than 0.30.

Figure 2:
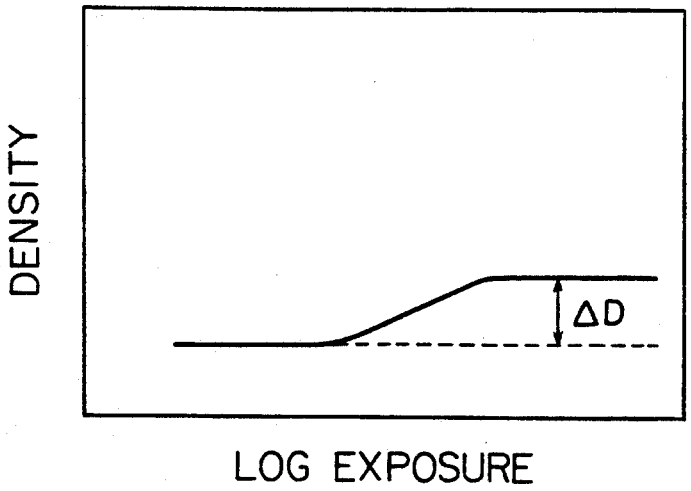
FIG. 2 shows the difference between the dotted line curve and the solid-line curve; i.e., the formed color density of the medium-speed sublayer.

Further, a sample is prepared in the same manner as in the foregoing sample except that the silver halide and the coupler are removed from the medium-speed sublayer and instead to the sublayer is added 0.08g/m$^2$ of the following compound C-3, whereby the sublayer is made into a substantially non-color forming layer containing gelatin alone, provided that the amount of gelatin is properly adjusted so as not to cause the whole layer thickness to change. This sample is exposed for 1/100 sec. through an optical wedge with a W-26 filter, manufactured by Eastman Kodak Company, to a white light, and then subjected to Processing B to obtain a characteristic curve (dotted line in FIG. 1). The foregoing sample containing the silver halide and the coupler in the medium-speed sublayer is also exposed and processed in the same manner to obtain its characteristic curve (solid line in FIG. 1), and its difference (oblique-lined portion in FIG. 1) from the above sample is found to determine the maximum formed color density of the sublayer (FIG. 2).

C-3

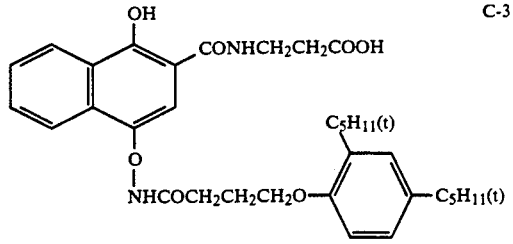

In the invention, the cyan coupler used for the red-sensitive layer is preferably one having the following Formula CU:

Formula CU

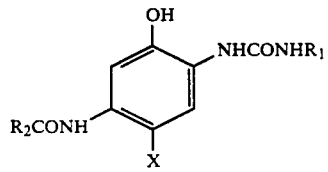

wherein X represents a hydrogen atom or a substituent capable of splitting off upon its coupling reaction with the oxidation product of an aromatic primary amine color developing agent; $R_1$ represents an aryl group or a heterocyclic group; and $R_2$ represents an aliphatic group or an aryl group. The groups represented by $R_1$ and $R_2$ include those having a substituent, and those capable of forming dimers or polymers. And the $R_1$ and $R_2$ independently or in cooperation with each other take a form or magnitude necessary to render a nondiffusibility to the coupler having Formula CU and a dye derived therefrom.

The aryl group represented by $R_1$ or $R_2$ is a phenyl group or a naphthyl group.

The substituent represented by $R_1$ or $R_2$ includes nitro, cyano, halogen, alkyl, aryl, amino, hydroxy, acyl, alkoxycarbonyl, aryloxycarbonyl, alkylsulfonyl, arylsulfonyl, alkoxysulfonyl, aryloxysulfonyl, carbamoyl, sulfamoyl, acyloxy, carbonamido and sulfonamido groups. The number of the substituents is preferably 1 to 5, provided that when 2 or more, the substituents may be either the same or different.

The preferred substituent to $R_1$ is an alkylsulfonyl group, a cyano group or a halogen atom, and that to $R_2$, is one represented by the following Formula CU-II:

Formula CU-II

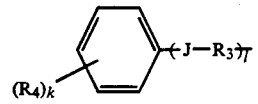

wherein $R_3$ is an alkylene group; $R_4$ is a substituent; J is an oxygen atom or a sulfur atom; k is an integer of zero to 4; and 1 is an integer of zero or 1, provided that when k is 2 or more, the two or more $R_4$s may be either the same or different.

Examples of the substituent represented by $R_4$ include alkyl, aryl, alkoxy, aryloxy, hydroxy, acyloxy, alkylcarbonyloxy, arylcarbonyloxy, carboxy, alkoxycarbonyl, aryloxycarbonyl, alkylthio, acyl, acylamino, sulfonamido, carbamoyl and sulfamoyl groups.

The split-off substituent represented by X is a group having a halogen, oxygen or nitrogen atom directly bonded to the coupling position thereof, such as an aryloxy, carbamoyloxy, carbamoylmethoxy, acyloxy, sulfonamido or succinic acid imido group, and examples of the group include those described in U.S. Pat. No. 3,741,563, JP O.P.I. Nos. 37425/1972 and 10135/1975, and JP E.P. Nos. 36894/1973, 117422/1975, 130441/1975, 108841/1976, 120334/1975, 18315/1977 and 105226/1978.

The preferred as X is —OR, wherein R is an alkyl, alkenyl, aryl, heterocyclic or cycloalkyl group. These groups include those having a substituent.

The following are the examples of the ureidophenol cyan coupler.

Exemplified compounds

CU-1

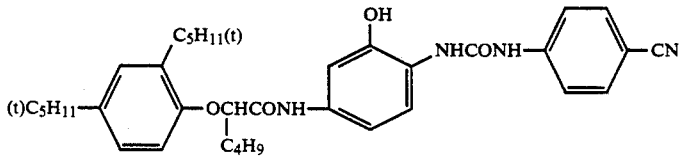

CU-2

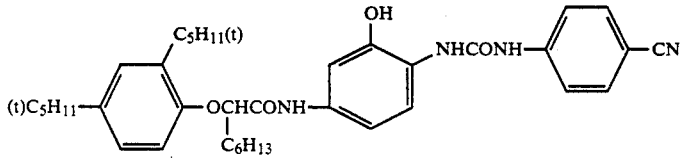

CU-3

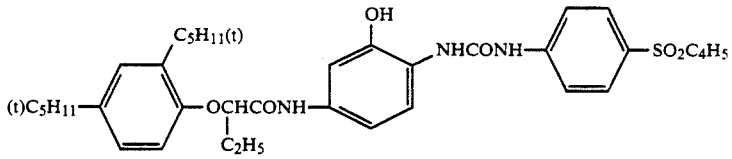

CU-4

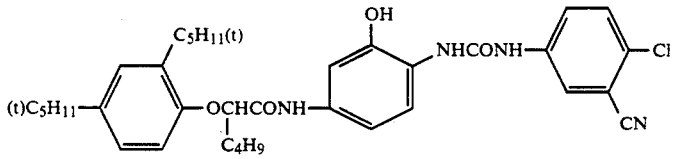

CU-5

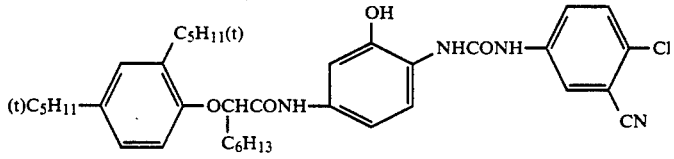

CU-6

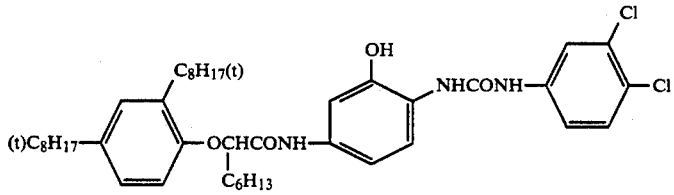

CU-7

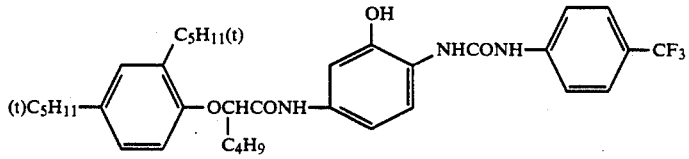

CU-8

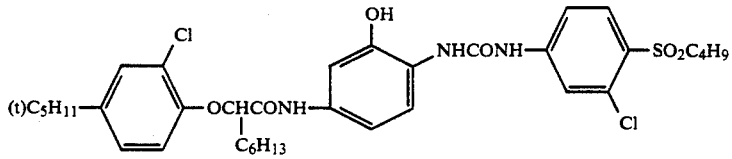

-continued
Exemplified compounds
CU-9
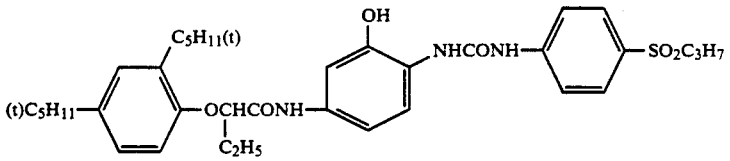
CU-10
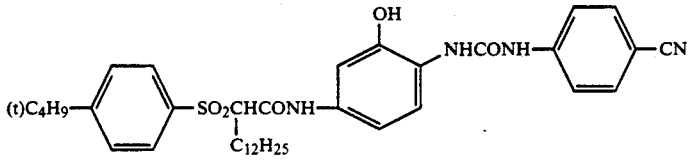
CU-11
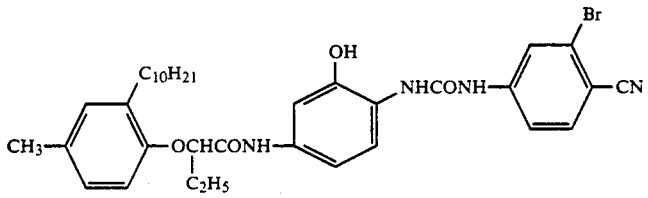
CU-12
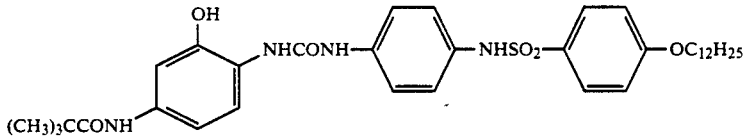
CU-13
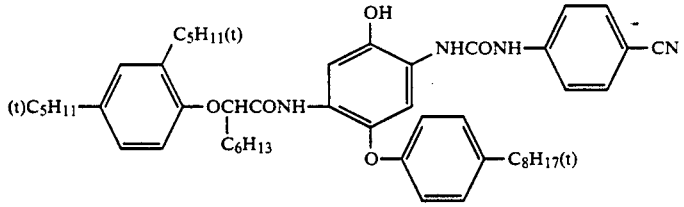
CU-14
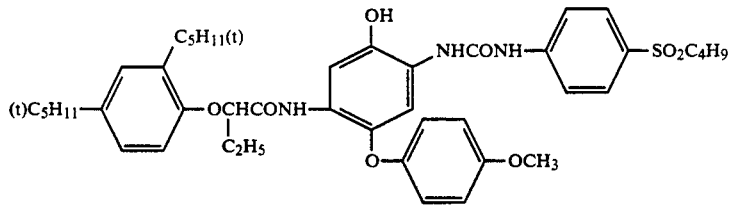
CU-15
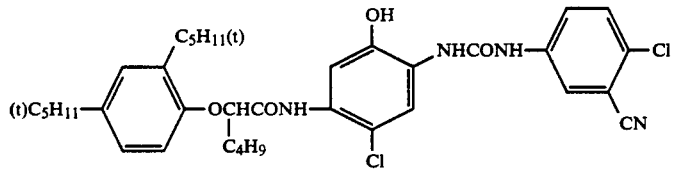
CU-16
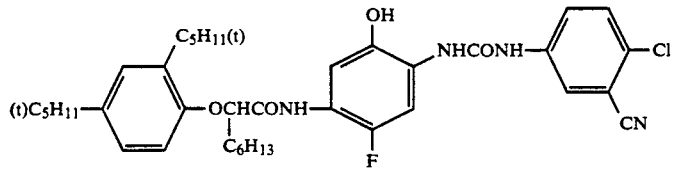

-continued
Exemplified compounds
CU-17
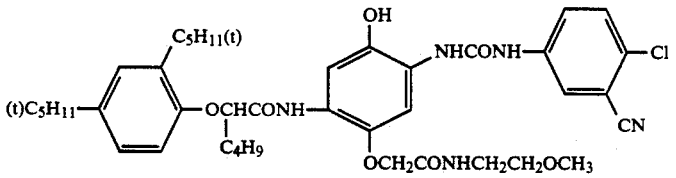
CU-18
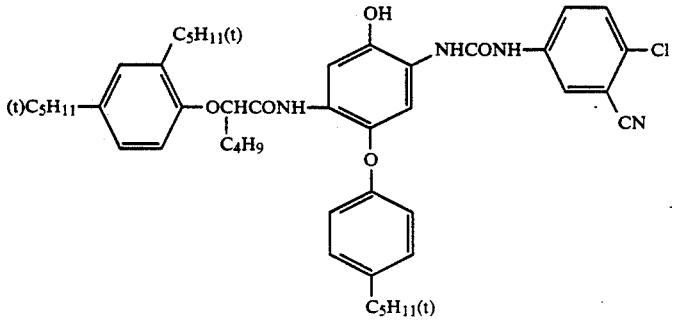
CU-19
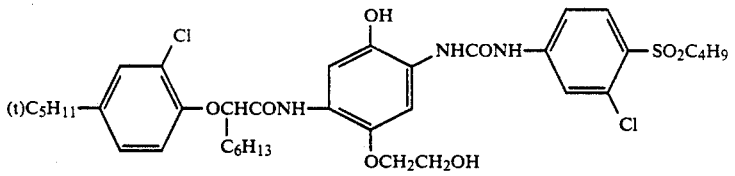
CU-20
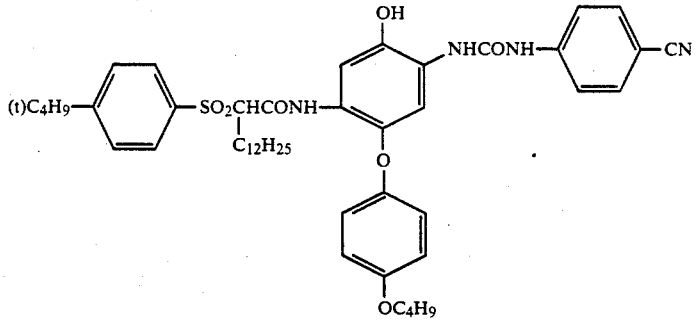
CU-21
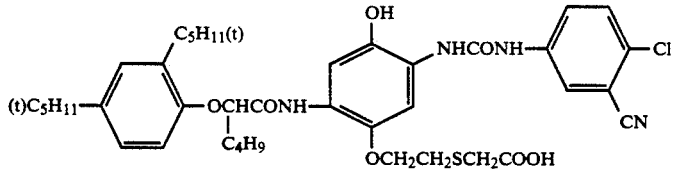
CU-22
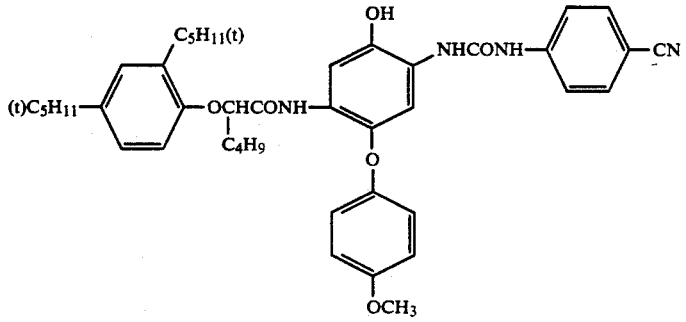

-continued
Exemplified compounds
CU-23
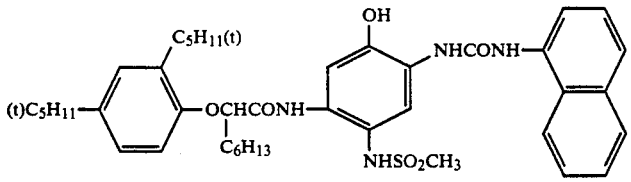
CU-24
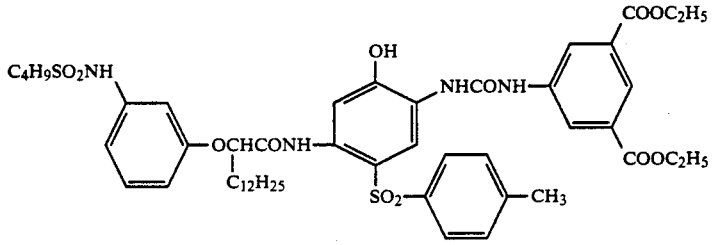
CU-25
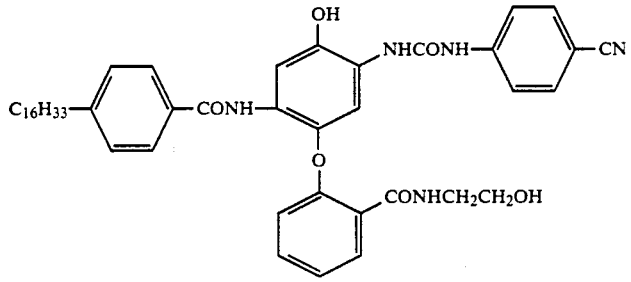
CU-26
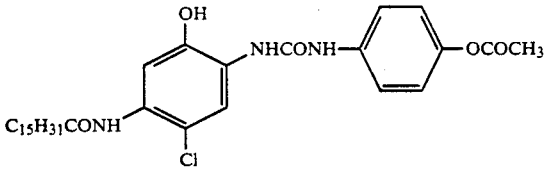
CU-27
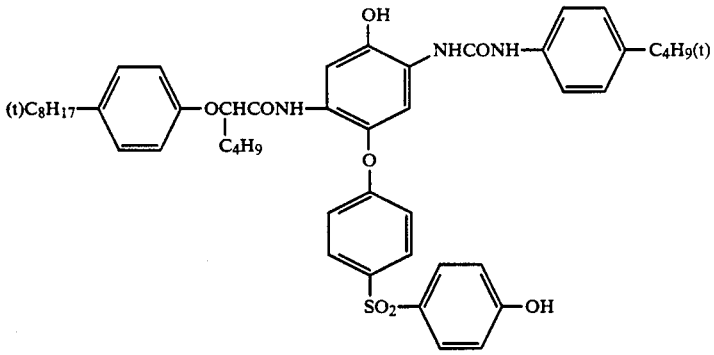
CU-28
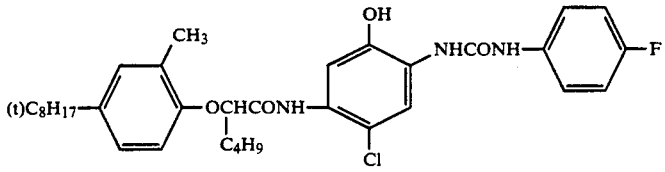

-continued
Exemplified compounds
CU-29
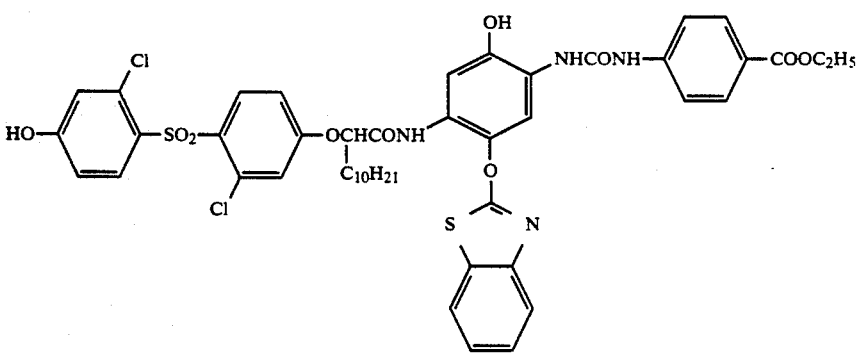
CU-30
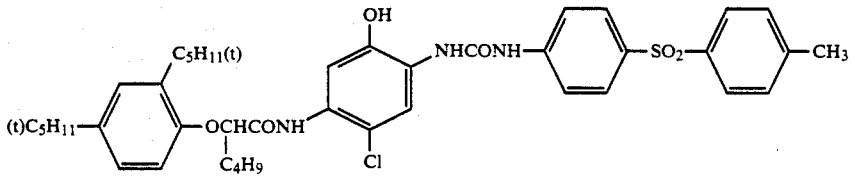
CU-31
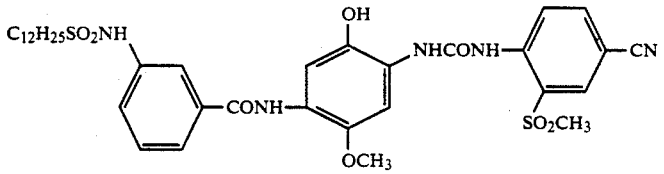
CU-32
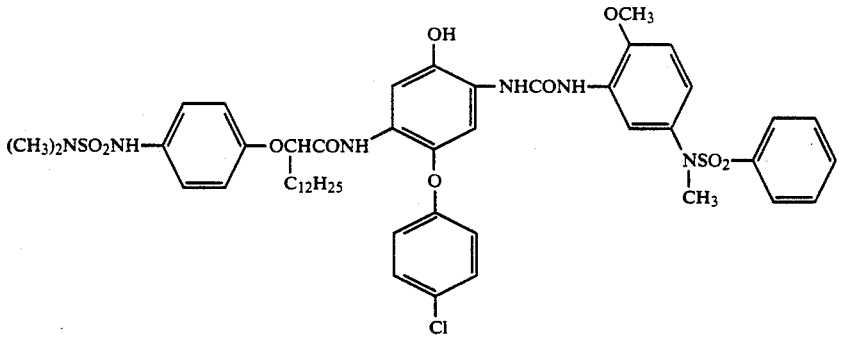
CU-33
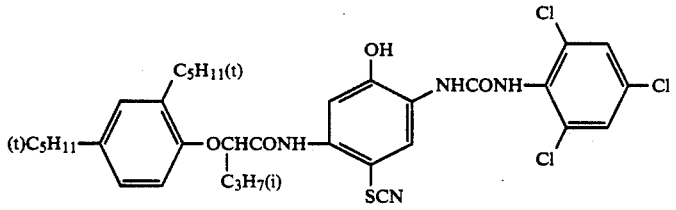
CU-34
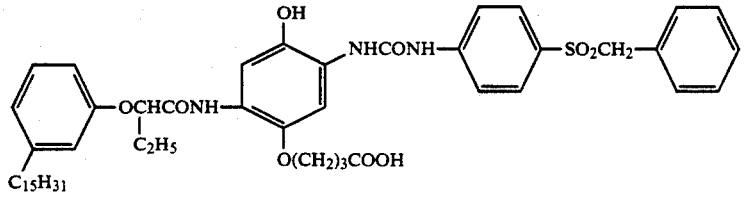

-continued
Exemplified compounds
CU-35
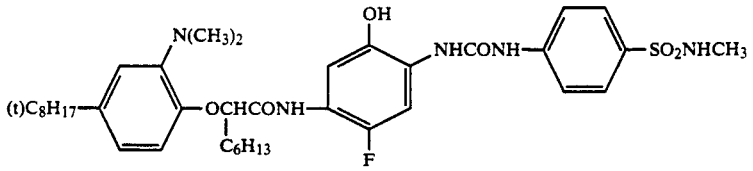
CU-36
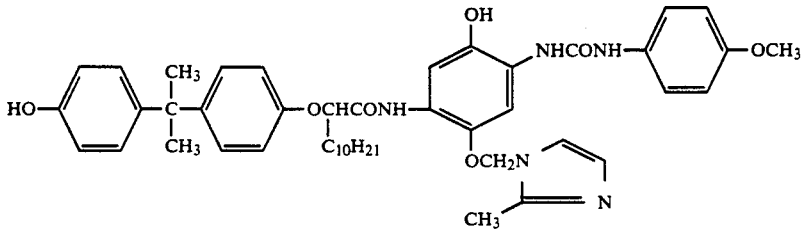
CU-37
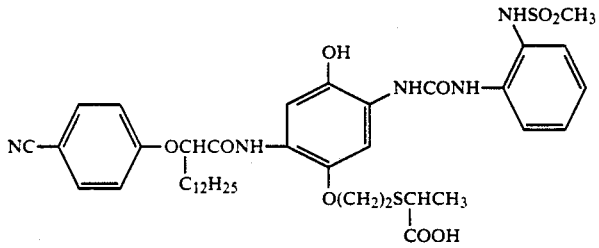
CU-38
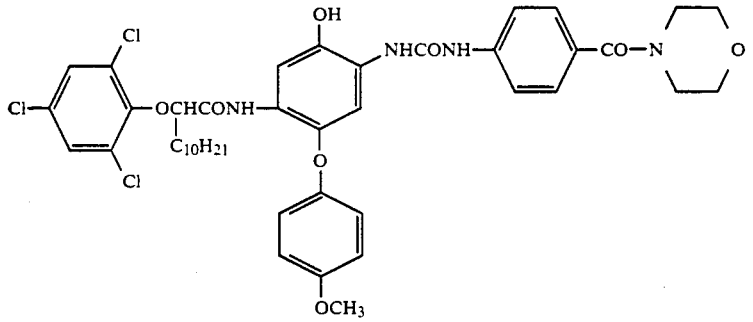
CU-39
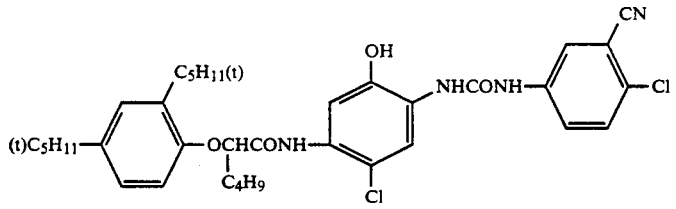
CU-40
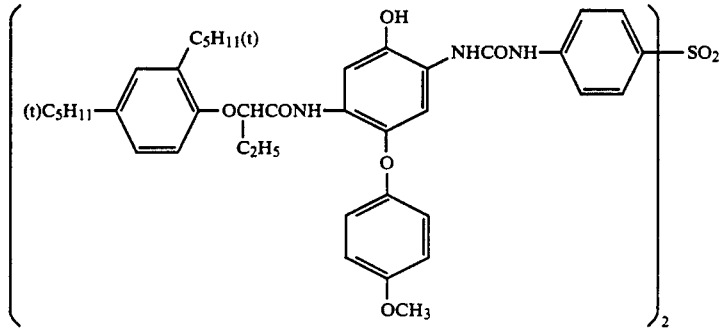

-continued

Exemplified compounds

CU-41

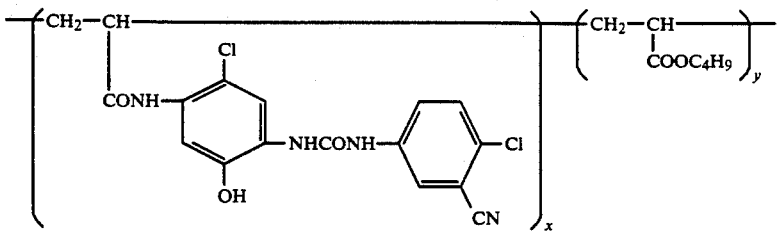

x:y = 50:50% by weight

CU-42

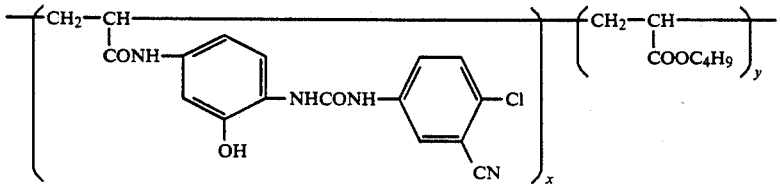

x:y = 50:50% by weight

Other examples of the ureidophenol cyan coupler are found in JP O.P.I Nos. 65134/1981, 204543/1982, 204544/1982, 204545/1982, 33249/1983, 33253/1982, 98731/1983, 118643/1983, 179838/1983, 187928/1983, 65844/1984, 71051/1984, 86048/1984, 165058/1984, 177558/1984, 180559/1984, 111644/1984, 131939/1984, 165058/1984, 49335/1985, 49336/1985, 50530/1985, 91355/1985, 107649/1985, 107650/1985 and 2757/1986.

The adding amount range of the ureidophenol cyan coupler is normally $1.0\times10^{-3}$ mol to 1 mol, and preferably $5.0\times10^{-3}$ mol to $8.0\times10^{-1}$ mol per mol of silver halide.

The method of adding the coupler of the invention, although not restricted, is preferably an oil-in-water dispersing method.

In the invention, the high-speed red-sensitive layer preferably contains a diffusible DIR compound.

The diffusible DIR compound herein is a compound which reacts with the oxidation product of a color developing agent to release a development inhibitor or a compound capable of releasing a development inhibitor, of which the diffusibility evaluated according to the following method is 0.40 or more.

The diffusibility is evaluated as follows:

Light-sensitive material Samples I and II having layers of the following compositions on a transparent support are prepared.

Sample I

Green-sensitive silver halide emulsion layer-having sample

A green-sensitized gelatino silver iodobromide emulsion (silver iodide content: 6 mol %, average grain size, 0.48 μm) containing 0.07 mol/mol Ag of the following coupler is coated on the support so as to have a silver coating weight of 1.1 g/m$^2$ and a gelatin coating weight of 3.0 g/m$^2$, and on the emulsion is coated a protective layer containing a gelatino silver iodobromide neither chemically sensitized nor spectrally sensitized (silver iodide content: 2 mol %, average grain size: 0.08 μm) so as to have a silver coating weight of 0.1 g/m$^2$ and a gelatin coating weight of 0.8 g/m$^2$.

Coupler

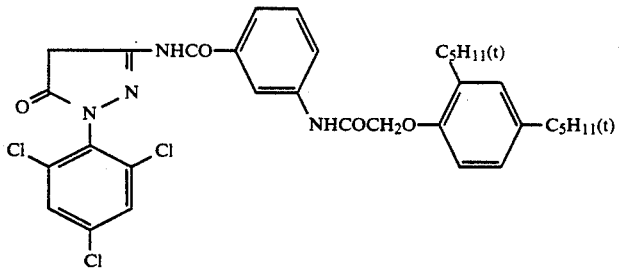

Sample II

Sample of the same composition as that of Sample I except that the protective layer contains no silver iodobromide.

The above samples contain a gelatin hardener and a surfactant in addition to the above compositions.

Each of Samples I and II is exposed through a wedge to a white light, and then processed in accordance with the following processing steps. Two different developer solutions are used: one containing various development inhibitors which restrain the sensitivity of Sample II to 60% (in logarithm, $-\Delta\log=0.22$) and the other containing no development inhibitors.

| Processing steps (38° C.) | |
|---|---|
| Color developing | 2 min. 40 sec. |
| Bleaching | 6 min. 30 sec. |
| Washing | 3 min. 15 sec. |
| Fixing | 6 min. 30 sec. |

-continued

| Processing steps (38° C.) | |
|---|---|
| Washing | 3 min. 15 sec. |
| Stabilizing | 1 min. 30 sec. |
| Drying | |

The compositions of the processing solutions used are as follows:

| | |
|---|---|
| Color developer | |
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrate | 2.5 g |
| Potassium hydroxide | 1.0 g |
| Water to make 1 liter | |
| Bleaching bath | |
| Ferric-ammonium ethylenediaminetetraacetate | 100.0 g |
| Diammonium ethylenediaminetatraacetate | 10.0 g |
| Ammonium bromide | 150.0 g |
| Glacial acetic acid | 10.0 ml |
| Water to make 1 liter | |
| Adjust pH to 6.0 with ammonia water | |
| Fixing bath | |
| Ammonium thiosulfate | 175.0 g |
| Anhydrous sodium sulfite | 8.5 g |
| Sodium metasulfite | 2.3 g |

-continued

| | |
|---|---|
| Water to make 1 liter | |
| Adjust pH to 6.0 with acetic acid. | |
| Stabilizing bath | |
| Formalin (37% solution) | 1.5 ml |
| Koniducks (product of KONICA Corp.) | 7.5 ml |
| Water to make 1 liter. | |

The desensitized degree of Sample 1:

$$\Delta S = S_0 - S_I,$$

the desensitized degree of Sample 2:

$$\Delta S_0 = S_0' S_{II}, \text{ and}$$

diffusibility $= \Delta S / \Delta S_0$, wherein $S_0$ and $S_0'$ are the sensitivities of Sample 1 and Sample 2, respectively, when processed in the developer containing no development inhibitor; and $S_I$ and $S_{II}$ are the sensitivities of Sample 1 and Sample 2, respectively, when processed in the developer containing a development inhibitor; provided that all the above sensitivities are values in terms of logarithm of reciprocal of the exposure amount (−log E) at the fog+0.3 density point.

The diffusibilities of several development inhibitors obtained in accordance with the above manner are exemplified in the following table.

TABLE

| Chemical structure | Adding amt. (mol/l) | Desensitized degree $\Delta S_0$ | Desensitized degree $\Delta S$ | Diffusibility $\Delta S/\Delta S_0$ |
|---|---|---|---|---|
| 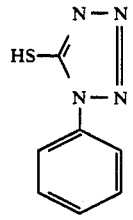 | $1.3 \times 10^{-5}$ | 0.22 | 0.05 | 0.23 |
| 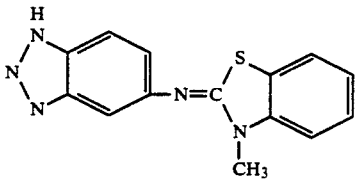 | $1.3 \times 10^{-5}$ | 0.23 | 0.03 | 0.34 |
| 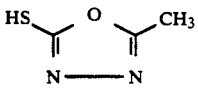 | $2.5 \times 10^{-5}$ | 0.22 | 0.10 | 0.45 |
| 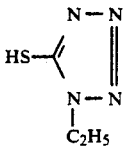 | $3.0 \times 10^{-5}$ | 0.21 | 0.10 | 0.48 |

TABLE-continued

| Chemical structure | Adding amt. (mol/l) | Desensitized degree $\Delta S_0$ | Desensitized degree $\Delta S$ | Diffusibility $\Delta S/\Delta S_0$ |
|---|---|---|---|---|
| 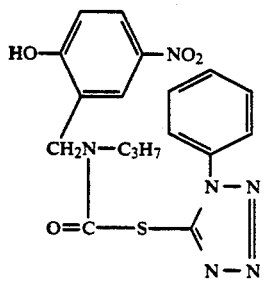 | $1.4 \times 10^{-5}$ | 0.23 | 0.11 | 0.48 |
| 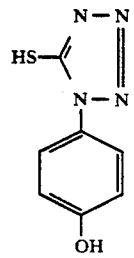 | $2.5 \times 10^{-5}$ | 0.22 | 0.13 | 0.59 |
| 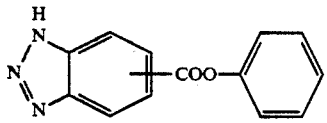 | $3.5 \times 10^{-5}$ | 0.23 | 0.15 | 0.65 |
| 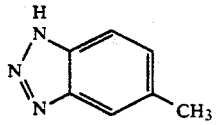 | $4.3 \times 10^{-5}$ | 0.22 | 0.16 | 0.73 |
| 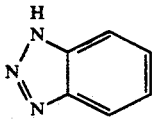 | $1.7 \times 10^{-4}$ | 0.21 | 0.20 | 0.95 |

As the diffusible DIR compound of the invention there may be used any DIR compound regardless of its chemical structure as long as the diffusibility of the group released therefrom is within the aforementioned range. The following is a formula representing such diffusible DIR compounds.

Formula D-1

$$A-(Y)_m$$

wherein A represents a coupler residue: m is an integer of 1 or 2; and Y is a group which combines with the coupler residue A in its coupling position and which, upon the coupler's reaction with the oxidation product of a color developing agent, is capable of splitting off to release a development inhibitor group or a development inhibitor having a diffusibility of not less than 0.40.

In Formula D-1, Y is typically represented by the following Formulas D-2 through D-19:

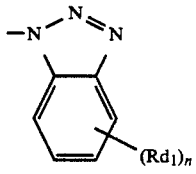

Formula D-2

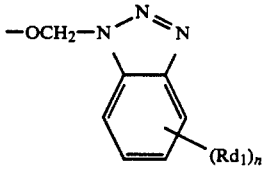

Formula D-3

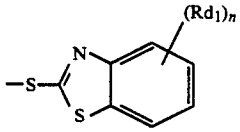

Formula D-4

-continued

Formula D-5

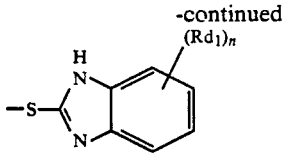

Formula D-6

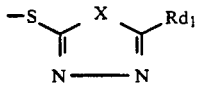

Formula D-7

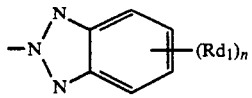

Formula D-8

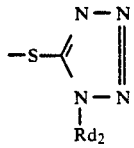

Formula D-9

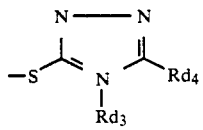

In Formulas D-2 to D-7, represents a hydrogen atom or an alkyl, alkoxy, acylamino, alkoxycarbonyl, thiazolidinylidenamino, aryloxycarbonyl, acyloxy, carbomoyl, N-alkylcarbomoyl, N,N-dialkylcarbamoyl, nitro, amino, N-arylcarbamoyloxy, sulfamoyl, N-alkylcarbamoyloxy, hydroxyl, alkoxycarbaonylamino, alkylthio, aryl, heterocyclic, cyano, alkylsulfonyl or aryloxycarbonylamino group; and n is an integer of 0, 1 or 2, provided that when n is 2, the $Rd_1$s may be either the same or different, and the total number of carbon atoms contained in n number of $Rd_1$s is 0 to 10, while the number of carbon atoms contained in the $Rd_1$ of Formula D-6 is 0 to 15.

In Formula D-6, X represents an oxygen atom or a sulfur atom.

In Formula D-8, $Rd_2$ represents an alkyl group, an aryl group or a heterocyclic group.

In Formula D-9, $Rd_3$ is a hydrogen atom or an alkyl, cycloalkyl, aryl or heterocyclic group; and $Rd_4$ represents a hydrogen atom, a halogen atom or an alkyl, cycloalkyl, aryl, acylamino, alkoxycarbonylamino, aryloxycarbonylamino, alkanesulfonamido, cyano, heterocyclic, alkylthio or amino group.

The alkyl group represented by $Rd_1$, $Rd_2$, $Rd_3$ or $Rd_4$ includes one having a substituent, which may be either straight-chain or branched-chain.

The aryl group represented by $Rd_1$, $Rd_2$, $Rd_3$ or $Rd_4$ includes one having a substituent.

The heterocyclic group represented by $Rd_1$, $Rd_2$, $Rd_3$ or $Rd_4$ include one having a substituent, and is preferably a 5- or 6-member single ring or condensed ring containing at least one hetero atom selected from the group consisting of a nitrogen atom, an oxygen atom and a sulfur atom. Examples of the heterocyclic group include pyridyl, quinolyl, furyl, benzothiazolyl, oxazolyl, imidazolyl, thiazolyl, triazolyl, benzotriazolyl, imido and oxazine groups.

The number of carbon atoms contained in the $Rd_2$ of Formulas D-6 to D-8 is 0 to 15.

In Formula D-9, the total number of carbon atoms contained in $Rd_3$ and $Rd_4$ is 0 to 15.

Formula D-10

–TIME–INHIBIT wherein TIME represents a group which combines with A in its coupling position and which is cleavable upon the reaction with the oxidation product of a color developing agent and, after being cleaved from the coupler, properly controls and releases the INHIBIT group.

The INHIBIT group is a group which, after being released, becomes a development inhibitor and which includes those repre-sented by the foregoing Formulas D-2 to D-9.

In Formula D-10, the –TIME–INHIBIT group is typically represented by the following Formulas D-11 through D-19.

Formula D-11

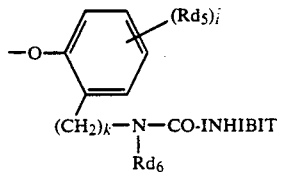

Formula D-12

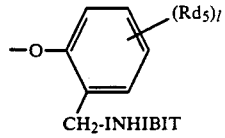

Formula D-13

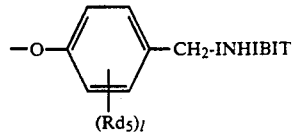

Formula D-14

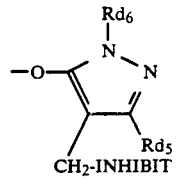

Formula D-15

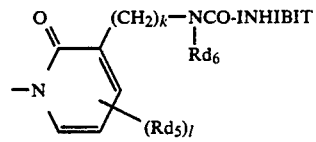

Formula D-16

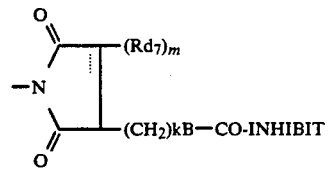

Formula D-17

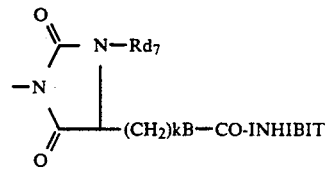

-continued

Formula D-18

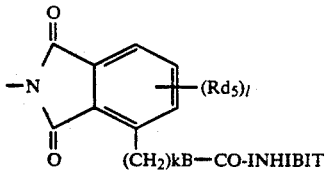

Formula D-19

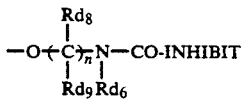

In Formulas D-11 through D-15 and D-18, $Rd_5$ represents a hydrogen atom, a halogen atom or an alkyl, cycloalkyl, alkenyl, aralkyl, alkoxy, alkoxycarbonyl, anilino, acylamino, ureido, cyano, nitro, sulfonamido, sulfamoyl, carbamoyl, aryl, carboxyl, sulfo, hydroxyl or alkanesulfonyl group. In Formulas D-11 through D-13, D-15 and D-i18, the $Rd_5$s may combine with each other to form a condensed ring. In Formulas D-11, D-14, D-15 and D-19, $Rd_6$ represents an alkyl, alkenyl, aralkyl, cycloalkyl, heterocyclic or aryl group. In Formulas D-16 and D-17, $Rd_7$ represents a hydrogen atom or an alkyl, alkenyl, aralkyl, cycloalkyl, heterocyclic or aryl group. In Formula D-19, $Rd_8$ and $Rd_9$ each represent a hydrogen atom or an alkyl group preferably having 1 to 4 carbon atoms. In Formulas D-11 and D-15 to D-18, k is an integer of 0, 1 or 2. In Formulas D-11 to D-13, D-15 and D-18, l is an integer of 1 to 4. In Formula D-16, m is an integer of 1 or 2, provided that when m is 2, the $Rd_7$ may be either the same or different. In Formula D-19, n is an integer of 2 to 4, and the n number of $Rd_8$s and $Rd_9$s may be either the same or different. In Formulas D-16 to D-18, B represents an oxygen atom or

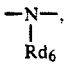

wherein $Rd_6$ is as defined previously. In Formula D-16. ... implies that t may be either a single bond or double bond, and in the case of a single bond, m is 2, while in the case of a double bond, m is 1. The INHIBIT groups represented by Formulas D-2 to D-9 have the same meaning except the formulas and the number of carbon atoms.

In Formulas D-2 to D-7, the total number of carbon atoms contained in $Rd_1$ is 0 to 32; in Formula D-8, the number of carbon atoms is 1 to 32; and in Formula D-9, the total number of carbon atoms contained in $Rd_3$ and $Rd_4$ is 0 to 32.

The alkyl, aryl and cycloalkyl groups represented by $Rd_5$, $Rd_6$ or $Rd_7$ include those having a substituent.

Preferred among the diffusible DIR compounds are those in which Y is represented by Formula D-2, D-3 or D-10. Preferred among the groups represented by Formula D-10 are those in which INHIBIT is represented by Formula D-2, D-6 particularly in which X is an oxygen atom, or D-8 particularly in which $Rd_2$ is a hydroxyaryl group or an alkyl group having 1 to 5 carbon atoms.

The coupler moiety represented by A in Formula D-1 includes a yellow dye image-forming coupler residue, a magenta dye image-forming coupler residue, a cyan dye image-forming coupler residue and colorless coupler residue.

The following are the useful diffusible DIR compounds for the invention.

Exemplified compounds

D-1

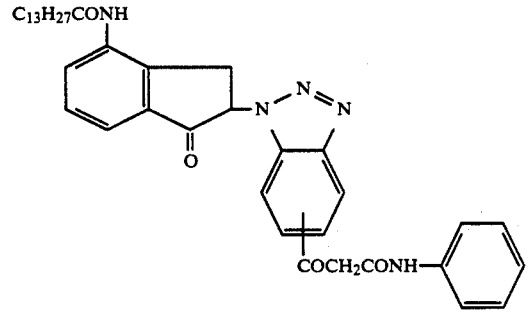

| compound No. | $R_1$ | $R_2$ | Y |
|---|---|---|---|
| D-2 | (1) | (1) | (30) |
| D-3 | (2) | (3) | (30) |
| D-4 | (2) | (4) | (30) |
| D-5 | (7) | (6) | (31) |
| D-6 | (2) | (4) | (32) |
| D-7 | (2) | (5) | (36) |
| D-8 | (7) | (8) | (33) |

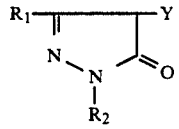

| compound No. | $R_1$ | $R_2$ | Y |
|---|---|---|---|
| D-9 | (9) | (10) | (30) |
| D-10 | (11) | (10) | (30) |
| D-11 | (12) | (7) | (34) |
| D-12 | (12) | (13) | (35) |
| D-13 | (9) | (14) | (36) |
| D-14 | (15) | (16) | (37) |

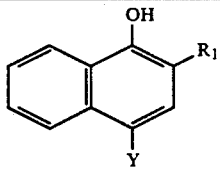

| compound No. | $R_1$ | Y |
|---|---|---|
| D-15 | (17) | (38) |
| D-16 | (17) | (39) |
| D-17 | (18) | (40) |
| D-18 | (20) | (41) |
| D-19 | (18) | (42) |
| D-20 | (18) | (43) |
| D-21 | (18) | (44) |
| D-22 | (19) | (45) |
| D-23 | (18) | (46) |
| D-24 | (21) | (47) |
| D-25 | (21) | (48) |
| D-26 | (22) | (49) |

-continued
| | | |
|---|---|---|
| D-27 | (22) | (50) |
| D-28 | (22) | (51) |
| D-29 | (23) | (52) |
| D-30 | (18) | (53) |
| D-31 | (18) | (54) |
| D-32 | (23) | (49) |
| D-33 | (18) | (55) |
| D-34 | (18) | (56) |
1 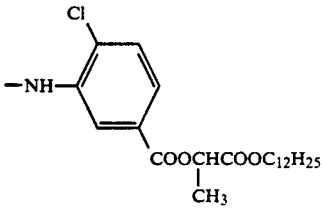
2 $-C(CH_3)_3$
3 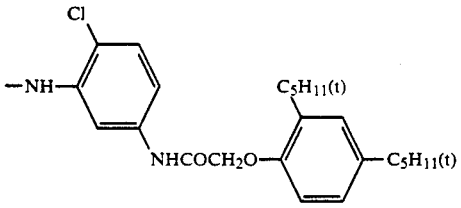
4 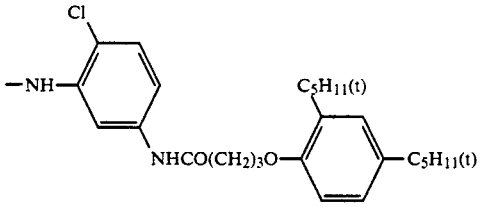
5 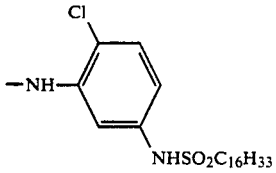
6 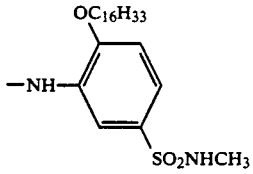
7 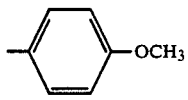
8 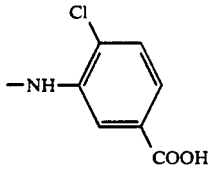
-continued
9 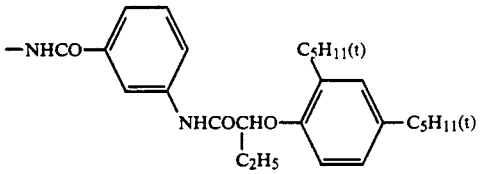
10 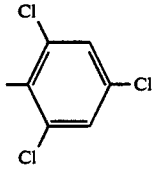
11 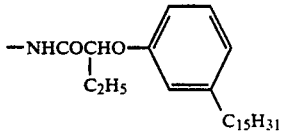
12 $-C_{17}H_{35}$
13 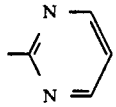
14 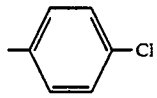
15 $-CH_3$
16 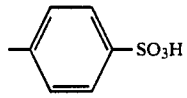
17 $-CONHC_{18}H_{37}$
18 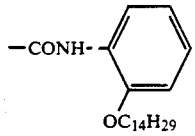
19 $-CONHC_{16}H_{33}$
20 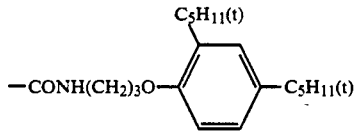
21 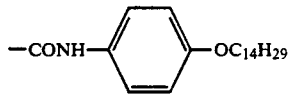
22 $-CONHCH_2CH_2COOH$
23 $-CONHCH_2CH_2COOCH_3$
30 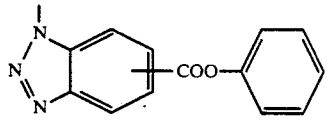

-continued
31 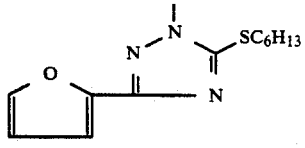
32 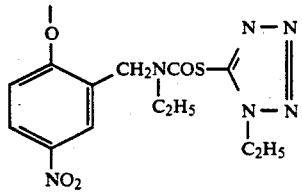
33 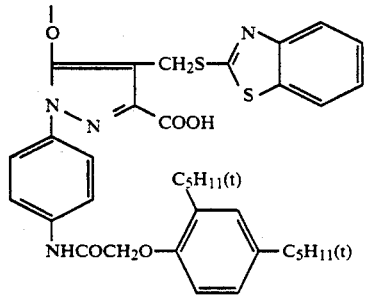
34 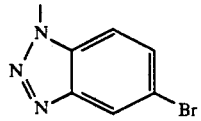
35 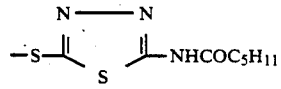
36 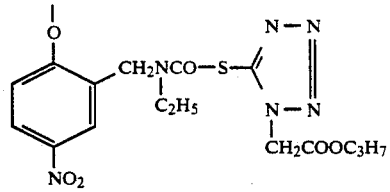
37 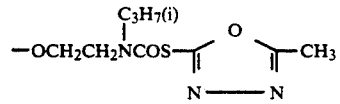
38 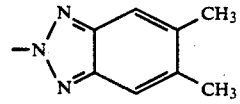
39 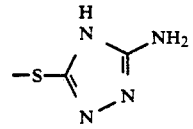
-continued
40 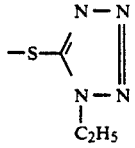
41 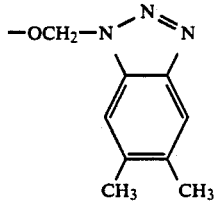
42 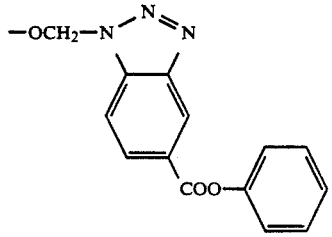
43 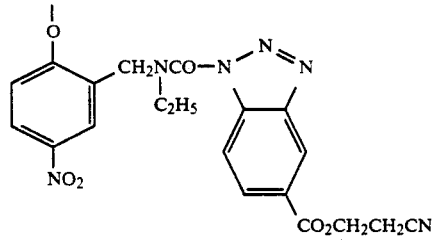
44 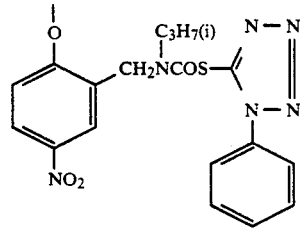
45 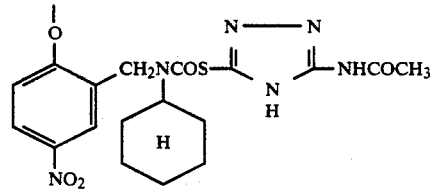
46 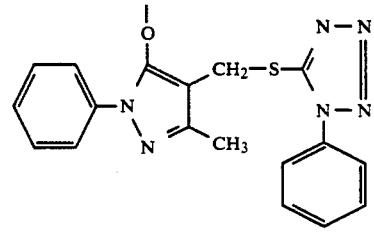

-continued

47

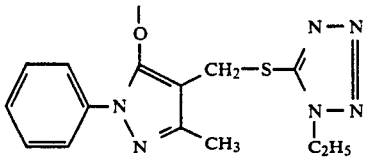

48

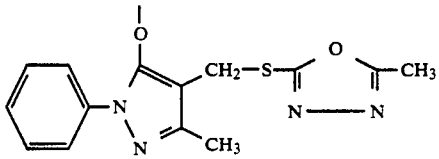

49

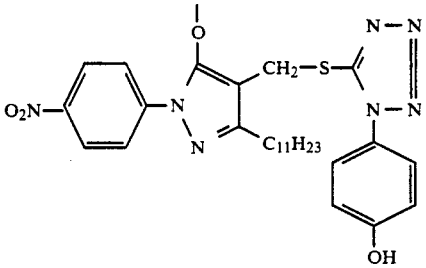

50

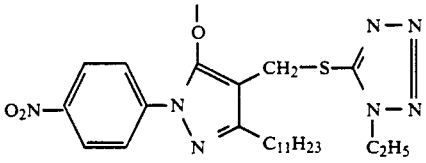

51

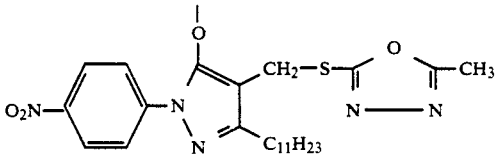

52

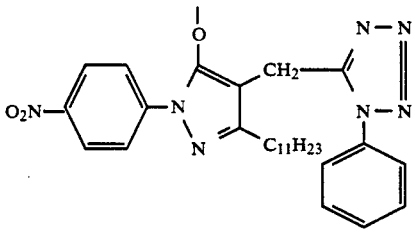

53

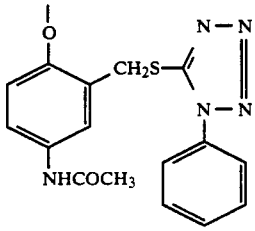

-continued

54

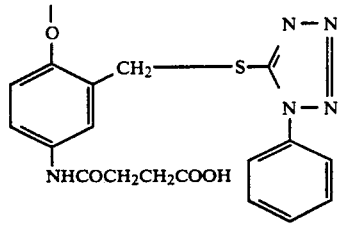

55

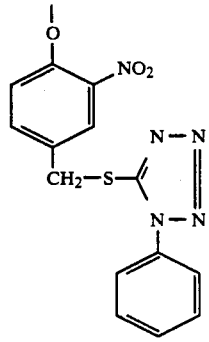

56

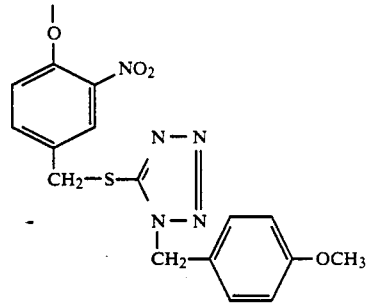

Including the above listed. compounds, examples of the diffusible DIR compounds usable in the invention are described in U.S. Pat. Nos. 4,234,678, 3,227,554, 3,617,291, 3,958,993, 4,149,886, 3,933,500, 2,072,363 and 2,070,266; JP O.P.I. Nos. 56837/1982 and 13239/1976; and Research Disclosure No. 21228, Dec. 1981.

The diffusible DIR compound is used in an amount of preferably 0.0001 to 0.1 mol, and more preferably 0.001 to 0.05 mol per mol of silver halide.

As the silver halide emulsion of the invention there may be used the emulsion described in Research Disclosure (hereinafter abbreviated to RD) 308119.

In the invention, the silver halide emulsion is subjected to chemical sensitization and spectral sensitization. The additives used in these sensitization processes are described in RD Nos. 17643, 18716 and 308119.

Other photographic additives usable in the invention also are described in the above Research Disclosure publications. In the invention, there may be used various couplers, examples of which are described in the above publications.

The additives used in the invention may be added according the methods described in RD308119.

In the invention, there may be used appropriate one of the support materials described in the aforementioned RD17643, p.28; RD18716, pp.647-648; and RD308119, X VII.

The light-sensitive material of the invention may have auxiliary layers such as filter layers and intermediate layers as described in RD308119, VII-K.

The light-sensitive material of the invention may take various layer structures such as the normal layer structure, inverted layer structure and unit structure described in the above RD308119, VII-K.

The light-sensitive material of the invention may be processed in the usual manner as described in RD17643, p.28–29, RD18716 and RD308119, X, XI.

EXAMPLES

In all the following examples, the adding amounts of the silver halide light-sensitive material's components except silver halide, colloidal silver and sensitizing dyes are shown in grams per $m^2$ unless otherwise stated. The amounts of silver halide and colloidal silver are in silver equivalents, and of sensitizing dyes in mols per mol of silver halide.

On a triacetyl cellulose film support were formed the following layers in order from the support side, whereby a multilayer color photographic light-sensitive material Sample 101 was prepared.

| | |
|---|---|
| Layer 1: Antihalation layer HC | |
| Black colloidal silver | 0.18 |
| UV absorbent UV-1 | 0.18 |
| Cyan dye DY-1 | 0.022 |
| High-boiling solvent Oil-1 | 0.18 |
| High-boiling solvent Oil-2 | 0.02 |
| Gelatin | 1.6 |
| Layer 2: Intermediate layer IL-1 | |
| Gelatin | 1.3 |
| Layer 3: Low-speed red-sensitive emulsion layer RL | |
| Silver iodobromide emulsion (average grain size: 0.4 μm) | 0.40 |
| Silver iodobromide emulsion (average grain size: 0.3 μm) | 0.20 |
| Sensitizing dye SD-1 | $1.9 \times 10^{-5}$ |
| Sensitizing dye SD-2 | $4.0 \times 10^{-4}$ |
| Sensitizing dye SD-3 | $2.2 \times 10^{-4}$ |
| Sensitizing dye SD-4 | $9.1 \times 10^{-5}$ |
| Cyan coupler C-1 | 0.67 |
| Colored cyan coupler CC-1 | 0.038 |
| DIR compound D-3 | 0.005 |
| High-boiling solvent Oil-1 | 0.57 |
| Gelatin | 1.1 |
| Layer 4: Medium-speed red-sensitive emulsion layer RM | |
| Silver iodobromide emulsion (average grain size: 0.7 μm) | 0.62 |
| Sensitizing dye SD-1 | amount shown in Table 1 |
| Sensitizing dye SD-2 | " |
| Sensitizing dye SD-3 | " |
| Sensitizing dye SD-4 | " |
| Cyan coupler C-1 | 0.28 |
| Colored cyan coupler CC-1 | 0.023 |
| DIR compound D-3 | 0.003 |
| High-boiling solvent Oil-1 | 0.25 |
| Gelatin | 0.6 |
| Layer 5: High-speed red-sensitive emulsion layer RH | |
| Silver iodobromide (average grain size: 0.8 μm) | 1.40 |
| Sensitizing dye SD-1 | $1.9 \times 10^{-5}$ |
| Sensitizing dye SD-2 | $1.7 \times 10^{-4}$ |
| Sensitizing dye SD-3 | $1.7 \times 10^{-4}$ |
| Cyan coupler C-2 | 0.13 |
| Colored cyan coupler CC-1 | 0.023 |
| DIR compound D-1 | 0.075 |
| High-boiling solvent Oil-1 | 0.21 |
| Gelatin | 1.1 |
| Layer 6: Intermediate layer IL-2 | |
| Gelatin | 0.8 |
| Layer 7: Low-speed green-sensitive emulsion layer GL | |
| Silver iodobromide emulsion (average grain size: 0.4 μm) | 0.65 |
| Silver iodobromide emulsion (average grain size: 0.3 μm) | 0.11 |
| Sensitizing dye SD-4 | $7.0 \times 10^{-5}$ |
| Sensitizing dye SD-5 | $6.4 \times 10^{-4}$ |
| Magenta coupler M-1 | 0.54 |
| Magenta coupler M-2 | 0.17 |
| Colored magenta coupler CM-1 | 0.048 |
| High-boiling solvent Oil-2 | 0.76 |
| Gelatin | 1.7 |
| Layer 8: Medium-speed green-sensitive emulsion layer GM | |
| Silver iodobromide emulsion (average grain size: 0.7 μm) | 0.54 |
| Sensitizing dye SD-4 | $7.8 \times 10^{-5}$ |

-continued

| | |
|---|---|
| Sensitizing dye SD-6 | $1.8 \times 10^{-4}$ |
| Sensitizing dye SD-7 | $1.1 \times 10^{-4}$ |
| Sensitizing dye SD-8 | $1.4 \times 10^{-5}$ |
| Magenta coupler M-1 | 0.074 |
| Magenta coupler M-2 | 0.034 |
| Colored magenta coupler CM-1 | 0.043 |
| DIR compound D-2 | 0.018 |
| High-boiling solvent Oil-2 | 0.30 |
| Gelatin | 0.6 |
| Layer 9: High-speed green-sensitive emulsion layer GH | |
| Silver iodobromide emulsion (average grain size: 0.9 μm) | 1.3 |
| Sensitizing dye SD-4 | $2.4 \times 10^{-5}$ |
| Sensitizing dye SD-6 | $1.5 \times 10^{-4}$ |
| Sensitizing dye SD-7 | $1.2 \times 10^{-4}$ |
| Sensitizing dye SD-8 | $3.8 \times 10^{-6}$ |
| Magenta coupler M-1 | 0.14 |
| Magenta coupler M-2 | 0.033 |
| Colored magenta coupler CM-1 | 0.038 |
| High-boiling solvent Oil-2 | 0.39 |
| Gelatin | 1.0 |
| Layer 10: Yellow filter layer YC | |
| Yellow colloidal silver | 0.08 |
| Antistain agent SC-1 | 0.1 |
| High-boiling agent Oil-2 | 0.13 |
| Gelatin | 0.8 |
| Formalin scaverger HS-1 | 0.042 |
| Formalin scavenger HS-2 | 0.042 |
| Layer 11: Intermediate layer IL-3 | |
| Formalin scaverger HS-1 | 0.046 |
| Formalin scavenger HS-2 | 0.046 |
| Gelatin | 0.5 |
| Layer 12: Low-speed blue-sensitive emulsion layer BL | |
| Silver iodobromide emulsion (average grain size: 0.3 μm) | 0.17 |
| Silver iodobromide emulsion (average grain size: 0.4 μm) | 0.17 |
| Silver iodobromide emulsion (average grain size: 0.7 μm) | 0.038 |
| Sensitizing dye SD-9 | $5.3 \times 10^{-4}$ |
| Sensitizing dye SD-10 | $7.2 \times 10^{-6}$ |
| Yellow coupler Y-1 | 0.61 |
| Yellow coupler Y-2 | 0.24 |
| High-boiling solvent Oil-2 | 0.17 |
| Gelatin | 1.3 |
| Formalin scaverger HS-1 | 0.073 |
| Formalin scavenger HS-2 | 0.16 |
| Layer 13: High-speed blue-sensitive emulsion layer BH | |
| Silver iodobromide emulsion (average grain size: 0.7 μm) | 0.32 |
| Silver iodobromide emulsion (average grain size: 1.0 μm) | 0.32 |
| Sensitizing dye SD-9 | $2.1 \times 10^{-4}$ |
| Sensitizing dye SD-10 | $7.6 \times 10^{-5}$ |
| Yellow coupler Y-1 | 0.17 |
| High-boiling solvent Oil-2 | 0.068 |
| Gelatin | 0.9 |
| Formalin scaverger HS-1 | 0.024 |
| Formalin scavenger HS-2 | 0.079 |
| Layer 14: First protective layer Pro-1 | |
| Fine-grained silver iodobromide emulsion (average grain size: 0.08 μm, AgI: 1 mol %) | 0.4 |
| UV absorbent UV-1 | 0.065 |
| UV absorbent UV-2 | 0.10 |
| High-boiling solvent Oil-1 | 0.07 |
| High-boiling solvent Oil-3 | 0.07 |
| Formalin scaverger HS-1 | 0.13 |
| Formalin scavenger HS-2 | 0.37 |
| Gelatin | 1.3 |
| Layer 15: Second protective layer Pro-2 | |
| Alkali-soluble matting agent (average particle size: 2 μm) | 0.15 |
| Polymethyl methacrylate (average particle size: 3 μm) | 0.04 |
| Lubricant WAX-1 | 0.04 |
| Gelatin | 0.6 |

-continued
C-1
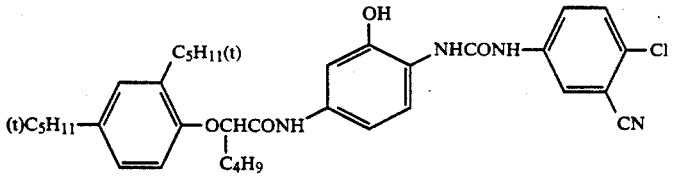
C-2
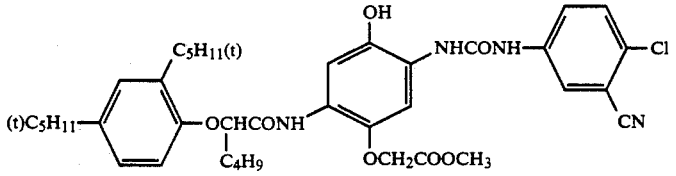
C-4
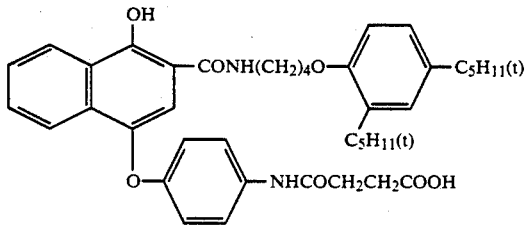
M-1
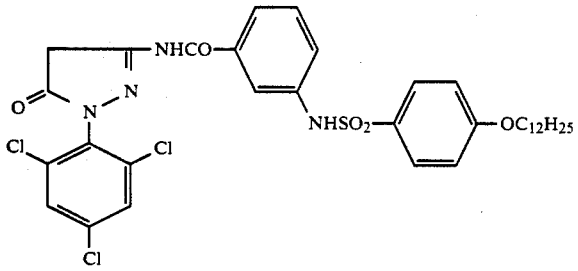
M-2
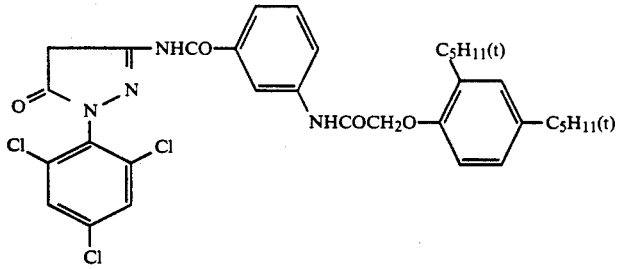
Y-1
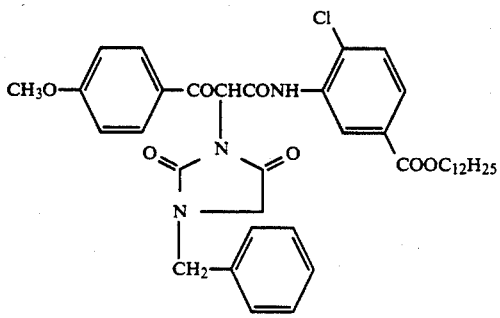

-continued
Y-2
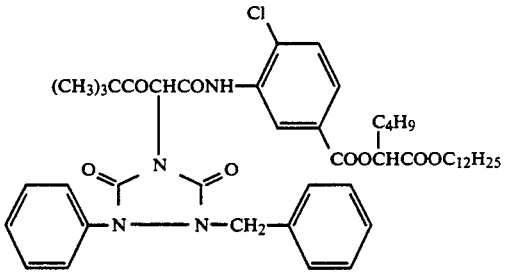
CC-1
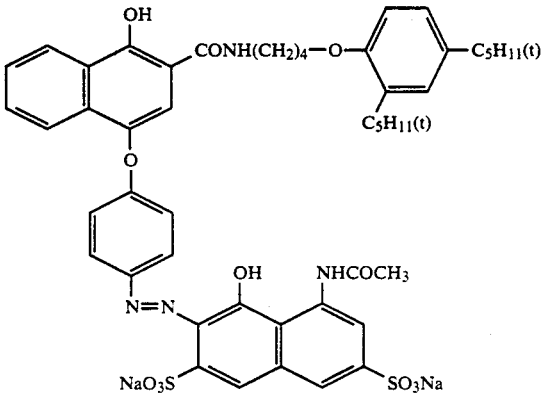
CM-1
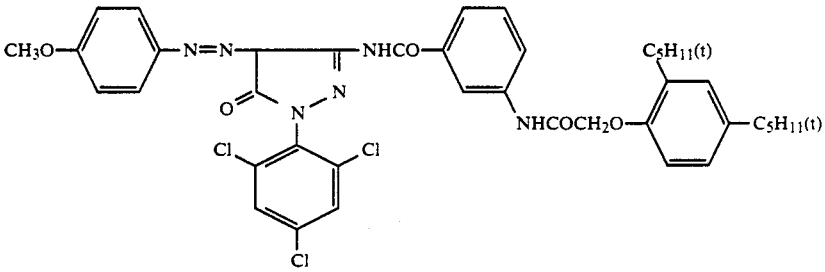
D-1
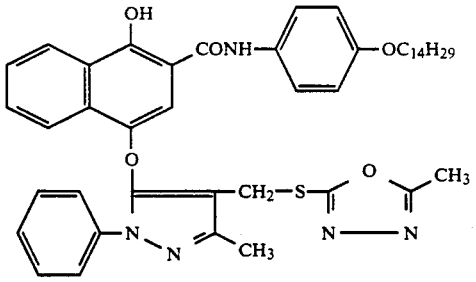
D-2
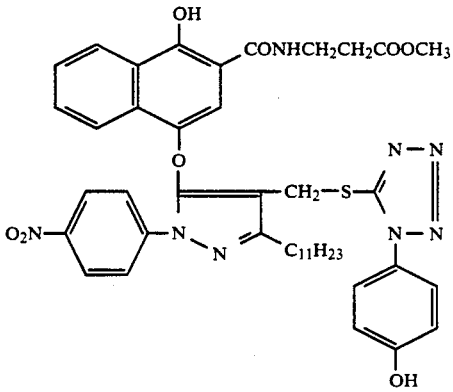

-continued
D-3
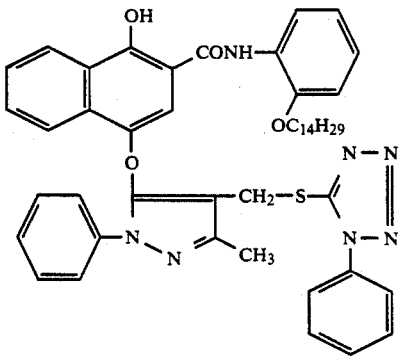
Oil-1
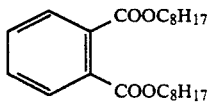
Oil-2
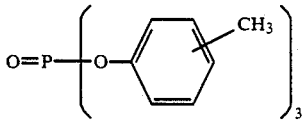
Oil-3
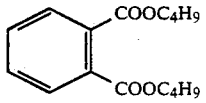
SC-1
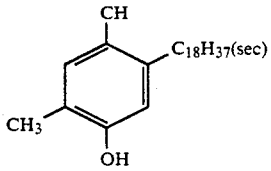
UV-1
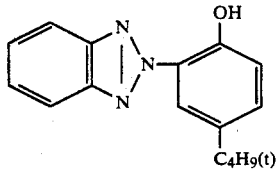
UV-2
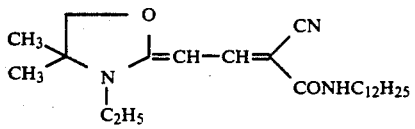
WAX-1
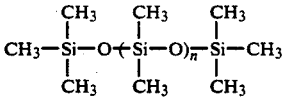
Weight average molecular weight Mw = 3,000
HS-1
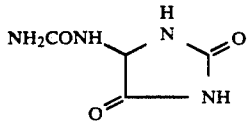

-continued
HS-2
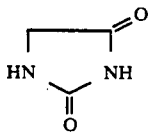
DY-1
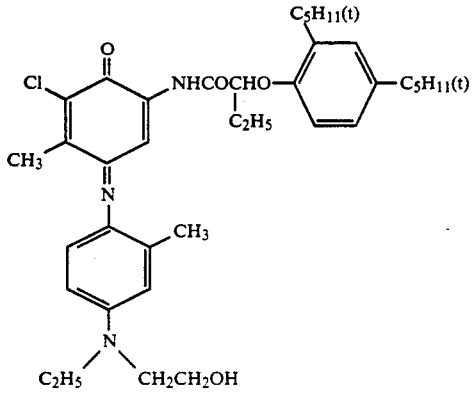
SD-1
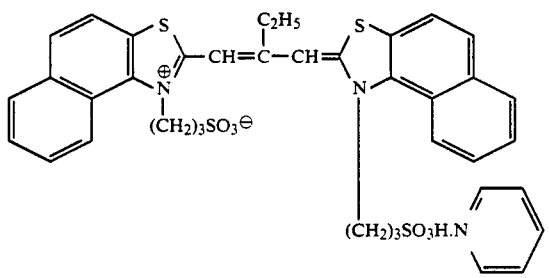
SD-2
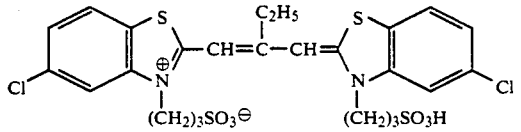
SD-3
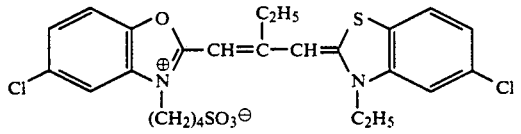
SD-4
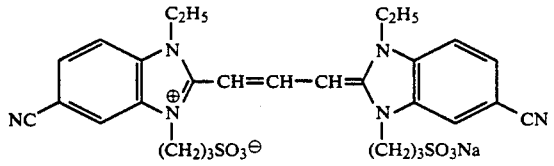
SD-5
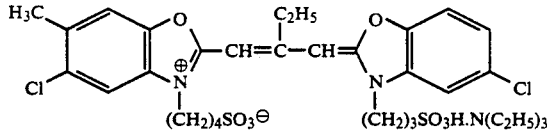
SD-6
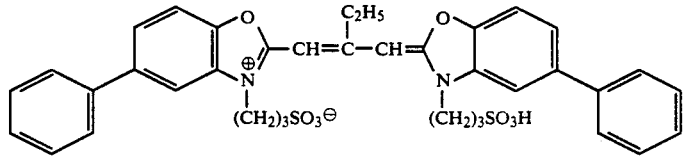

-continued

SD-7

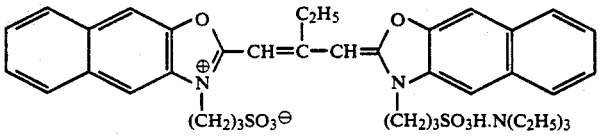

SD-8

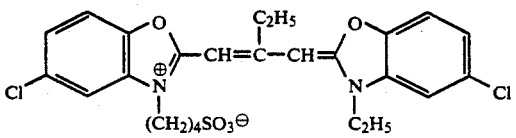

SD-9

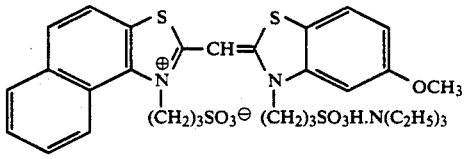

SD-10

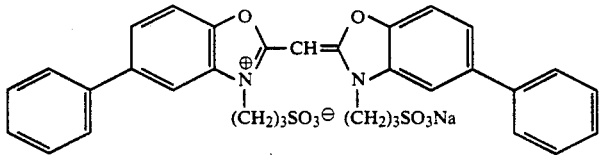

In addition to the above components, there were added coating aid Su-1, dispersing aid Su-2, viscosity control agent, hardeners H-1 and H-2, stabilizer ST-1, antifoggant AF-1 and two different antifoggants AF-2 having a $\overline{M}w$ of 10,000 and a $\overline{M}w$ of 1,100,000.

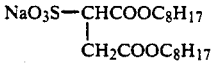

Su-1

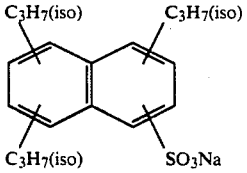

Su-2

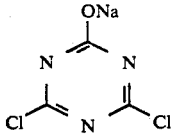

H-1

$(CH_2{=}CHSO_2CH_2)_2O$

H-2

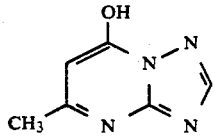

ST-1

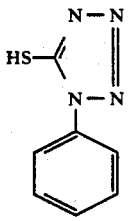

AF-1

-continued

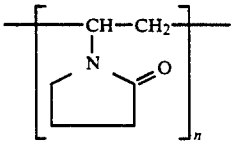

n: Polymerization degree

Next, Samples 102 to 105 were prepared in the same manner as in Sample 101 except that the sensitizing dyes of Layer 4 of Sample 101 were varied as shown in Table 1.

TABLE 1

| Sample No. | Sensitizing dyes used (mol/mol AgX) SD-1 | SD-2 | SD-3 | SD-4 |
|---|---|---|---|---|
| 101 | $4 \times 10^{-5}$ | $3.6 \times 10^{-4}$ | 0 | 0 |
| 102 | $2.6 \times 10^{-4}$ | $2.3 \times 10^{-4}$ | 0 | 0 |
| 103 | $2.6 \times 10^{-5}$ | $2.3 \times 10^{-4}$ | $1.3 \times 10^{-4}$ | $1.3 \times 10^{-5}$ |
| 104 | $2.0 \times 10^{-5}$ | $1.8 \times 10^{-4}$ | $1.0 \times 10^{-4}$ | $1.0 \times 10^{-4}$ |
| 105 | $1.6 \times 10^{-5}$ | $1.4 \times 10^{-4}$ | $8.0 \times 10^{-5}$ | $1.6 \times 10^{-4}$ |

Subsequently, Sample 106 was prepared in the same manner as in Sample 101 except that the cyan coupler C-2 of Layer 5 of Sample 101 was replaced by cyan coupler C-4. Similarly, the cyan coupler C-2 of Layer 5 of Sample 104 was replaced by cyan coupler C-4, whereby Sample 107 was prepared.

Further, the amount of the DIR compound D-1 of Layer 5 of Sample 104 was made zero to prepare Sample 108 and made 0.11 to prepare Sample 109.

Each of the thus prepared Samples 101 to 109 was examined through the procedure previously explained in the 'Detailed Description of the Invention' section to obtain its layer 4 (medium-speed red-sensitive layer)'s sensitivities to the respective wavelengths, and the results are shown in Table 2 And, the green-sensitive layer's sensitivity $S_G$ and the red-sensitive layer's sensitivity $S_R$ to the specific red light were found in accordance with the method previously explained in the same section to obtain their ratio $S_G/S_R$, and the ratio values are also given in Table 2.

Further, each of Samples 101 to 109 was loaded in a compact camera Z up80RC, manufactured by KONICA Corp., to photograph a Macbeth color rendition chart in daylight and also in a Triwave fluorescent light (PALOOK PS. manufactured by Matsushita Electric Industry Co.), and then subjected to the foregoing Processing B.

After that, the samples were printed so that the gray scale of the Macbeth chart is truly reproduced on the prints, and the color reproducibility of each sample was rated 1 to 5 by a panel of 10 judges, wherein 1 is the worst and 5 is the best. The averaged rated values were used for comparison of the samples.

The results obtained above are collectively shown in Table 2.

TABLE 2

| Sample | Ref. sensitivities of $S_{640}$ | | | | | Print rating | |
|---|---|---|---|---|---|---|---|
| | | | | | | Day- | Fluorescent |
| No. | $S_{600}$ | $S_{620}$ | $S_{660}$ | $S_{680}$ | $S_G/S_R$ | light | light |
| 101 | 0.73 | 0.85 | 1.11 | 0.73 | 0.42 | 2.1 | 1.1 |
| 102 | 0.73 | 0.85 | 1.20 | 1.25 | 0.45 | 3.2 | 2.0 |
| 103 | 0.61 | 0.95 | 0.63 | 0.10 | 0.32 | 4.2 | 3.0 |
| 104 | 0.60 | 0.94 | 0.65 | 0.21 | 0.20 | 4.0 | 4.2 |
| 105 | 0.73 | 0.94 | 0.59 | 0.12 | 0.22 | 4.8 | 4.0 |
| 106 | 0.73 | 0.82 | 1.09 | 0.72 | 0.55 | 1.1 | 1.0 |
| 107 | 0.61 | 0.95 | 0.64 | 0.19 | 0.40 | 2.2 | 1.8 |
| 108 | 0.63 | 0.92 | 0.62 | 0.20 | 0.50 | 2.1 | 1.2 |
| 109 | 0.64 | 0.89 | 0.63 | 0.19 | 0.15 | 4.8 | 5.0 |

As is apparent from Table 2, Samples 103, 104, 105 and 109, having the characteristics of the invention, have better improved color reproducibilities in daylight as well as in fluorescent light than the comparative Samples 101, 102, 106, 107 and 108.

What is claimed is:

1. A silver halide color photographic light-sensitive material comprising a support, having thereon a red-sensitive silver halide emulsion layer, a green sensitive silver halide emulsion layer and a blue sensitive silver halide emulsion layer, wherein said red-sensitive silver halide emulsion layer comprises a low speed red-sensitive silver halide emulsion sublayer, a medium-seed red-sensitive silver halide emulsion sublayer and a high-speed red-sensitive silver halide emulsion layer provided in this order from said support, and sensitivities $S_{600}$, $S_{620}$, $S_{640}$, $S_{660}$ and $S_{680}$ of said medium speed red-sensitive silver halide emulsion sublayer which are each determined as reciprocal of the exposure amount of light of wavelength of 600 nm, 620 nm, 640 nm, 660 nm and 680 nm necessary for forming an image having a density of fog+0.1 in said medium speed red-sensitive silver halide emulsion sublayer, respectively, satisfy the following relation;

$$0.5S_{640}<S_{600}<0.9S_{640},$$

$$0.7S_{640}<S_{620}<1.2S_{640},$$

$$0.4S_{640}<S_{660}<0.9S_{640} \text{ and}$$

$$S_{680}\leqq 0.4S_{640}, \text{ and}$$

sensitivities, $S_R$ and $S_G$, of said red-sensitive emulsion layer and said green-sensitive emulsion layer to a specific red light has the following relation;

$$S_G<0.35S_R.$$

2. A light-sensitive material of claim 1, wherein said sensitivities $S_{600}$, $S_{620}$, $S_{640}$, $S_{660}$ and $S_{680}$ of said medium speed red-sensitive silver halide emulsion sublayer have the following relations;

$$0.6S_{640}<S_{600}<0.8S_{640},$$

$$0.8S_{640}<S_{620}<1.1S_{640},$$

$$0.5S_{640}<S_{660}<0.7S_{640} \text{ and}$$

$$0.05S_{640}<S_{660}<0.3S_{640}.$$

3. A light-sensitive material of claim 1, wherein said medium speed red-sensitive silver halide emulsion sublayer contains a sensitizing dye represented by formula I, and a sensitizing dye represented by formula III;

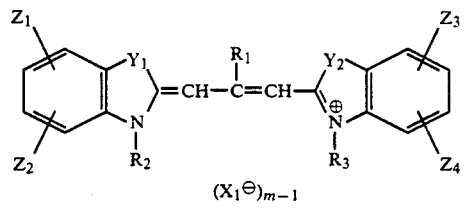

(I)

wherein $R_1$ is a hydrogen atom, an alkyl group or an aryl group; $R_2$ and $R_2$ are each an alkyl group; $Y_1$ and $Y_2$ are each a sulfur atom ar a selenium atom; $Z_1$, $Z_2$, $Z_3$ and $Z_4$ are each a hydrogen atom, a halogen atom, a hydroxy group, an alkoxy group, an amino group, an acyl group, an acylamino group, an acyloxy group, an aryloxy group, an alkoxycarbonyl group, an aryloxycarbonyl group, an alkoxycarbonylamino group, a sulfonyl group, a carbamoyl group, an aryl group, an alkyl group or a cyano group, $Z_1$ and $Z_2$, and/or $Z_3$ and $Z_4$ are allowed to be bonded with each other to form a ring; $X_1+$ is an anion; and m is an integer of 1 or 2, and m is 1 when an intramolecular salt is formed;

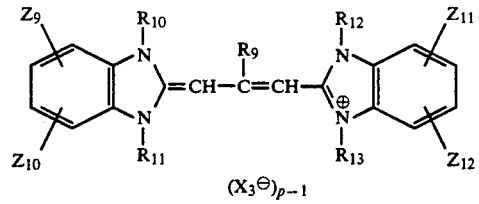

(III)

wherein $R_9$ is a hydrogen atom, an alkyl group or an aryl group; $R_{10}$, $R_{11}$, $R_{12}$ and $R_{13}$ are each an alkyl group; $Z_9$, $Z_{10}$, $Z_{11}$ and $Z_{12}$ are each a hydrogen atom, a halogen atom, a hydroxy group, an alkoxy group, an amino group, an acyl group, an acylamino group, an acyloxy group, an aryloxy group, an alkoxycarbonyl group, an aryloxycarbonyl group, an alkoxycarbonylaminic group, a carbamoyl group, an aryl group, an alkyl group, a cyano group or a sulfonyl group, $Z_9$ and $Z_{10}$, and/or $Z_{11}$ and $Z_{12}$ are allowed to be bonded with each other to form a ring; $X_3+$ is an anion; and p is an integer of 1 or 2, and p is 1 when an intramolecular salt is formed.

4. A light-sensitive material of claim 3, wherein said medium speed red-sensitive silver halide emulsion sublayer further contains a sensitizing dye represented by the following formula II;

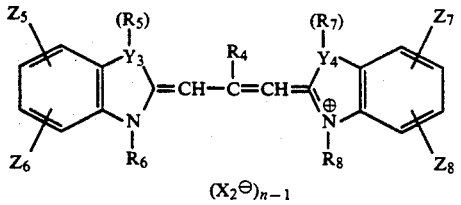

(II)

wherein $R_4$ a hydrogen atom, an alkyl group or an aryl group; $R_5$, $R_6$, $R_7$ and $R_8$ are each an alkyl group; $Y_3$ and $Y_4$ are each a nitrogen atom, an oxygen atom, a sulfur atom or a selenium atom provided that $Y_3$ and $Y_4$ are not nitrogen atoms at the same time, and $R_5$ and $R_7$ are not exist when $Y_3$ and $Y_4$ are an oxygen atom, a sulfur atom or a selenium atom; $Z_5$, $Z_6$, $Z_7$ and $Z_8$ are each a hydrogen atom, a halogen atom, a hydroxy group, an alkoxy group, an amino group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group, $Z_5$ and $Z_6$, and/or $Z_7$ and $Z_8$ are allowed to be bonded with each other to form a ring; $X_2+$ is an anion; and n is an integer of 1 or 2, and n is 1 when an intramolecular salt is formed.

5. A light-sensitive material of claim 1, wherein said red-sensitive emulsion layer contains a cyan coupler represented by formula CU;

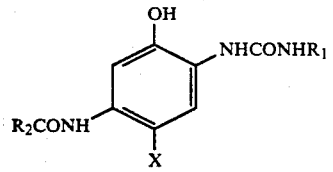

(CU)

wherein X is a hydrogen atom or a substituent capable of splitting off upon reaction with oxydation product of a primary amine color developing agent; $R_1$ is aryl or a heterocyclic; and $R_2$ is an aliphatic or an aryl group.

6. A light-sensitive material of claim 1, wherein said high speed red-sensitive silver halide emulsion sublayer contains a diffusible DIR compound having a diffusibility of not less than 0.40.

7. A silver halide color photographic light-sensitive material comprising a support, having thereon a red-sensitive silver halide emulsion layer, a green-sensitive silver halide emulsion layer and a blue-sensitive silver halide emulsion layer, wherein said red-sensitive comprises a low-speed red-sensitive silver halide emulsion sublayer, a medium-seed red-sensitive silver halide emulsion sublayer and a high-speed red-sensitive silver halide emulsion layer provided in this order from said support, and sensitivities $S_{600}$, $S_{620}$, $S_{640}$, and $S_{680}$ of said medium speed red sensitive silver halide emulsion sublayer which are each determined as reciprocal of the exposure amount of light of wavelength of 600 nm, 620 nm, 640 nm, 660 nm and 680 nm necessary for forming an image having a density of fog+0.1 in said medium speed red-sensitive silver halide emulsion sublayer, respectively, satisfy the following relation;

$$0.5S_{640}<S_{600}<0.9S_{640},$$

$$0.7S_{640}<S_{620}<1.2S_{640} \text{ and}$$

$$S_{680}\leqq 0.4S_{640}, \text{ and}$$

sensitivities, $S_R$ and $S_G$, of said red-sensitive emulsion layer and said green-sensitive emulsion layer to a specific red light has the following relation;

$$S_G<0.35S_R.$$

and said red-sensitive medium speed silver halide emulsion sublayer contains a sensitizing dye represented by formula I, a sensitizing dye represented by formula II and a sensitizing dye represented by formula III;

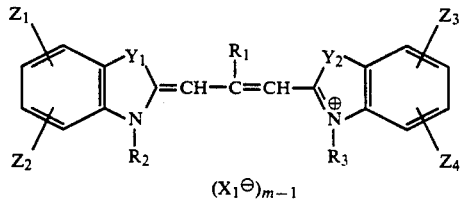

(I)

wherein $R_1$ is a hydrogen atom, an alkyl group or an aryl group; $R_2$ and $R_2$ are each an alkyl group; $Y_1$ and $Y_2$ are each a sulfur atom ar a selenium atom; $Z_1$, $Z_2$, $Z_3$ and $Z_4$ are each a hydrogen atom, a halogen atom, a hydroxy group, an alkoxy group, an amino group, an acyl group, an acylamino group, an acyloxy group, an aryloxy group, an alkoxycarbonyl group, an aryloxycarbonyl group, an alkoxycarbonylamino group, a sulfonyl group, a carbamoyl group, an aryl group, an alkyl group or a cyano group, $Z_1$ and $Z_2$, and/or $Z_3$ and $Z_4$ are allowed to be bonded with each other to form a ring; $X_1+$ is an anion; and m is an integer of 1 or 2, and m is 1 when an intramolecular salt is formed;

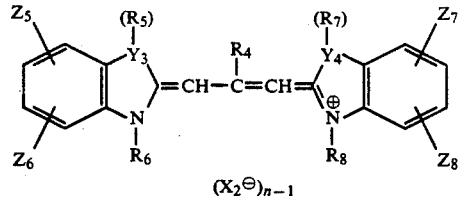

(II)

wherein $R_4$ a hydrogen atom, an alkyl group or an aryl group; $R_5$, $R_6$, $R_7$ and $R_8$ are each an alkyl group; $Y_3$ and $Y_4$ are each a nitrogen atom, an oxygen atom, a sulfur atom or a selenium atom provided that $Y_3$ and $Y_4$ are not nitrogen atoms at the same time, and $R_5$ and $R_7$ are nor exist when $Y_3$ and $Y_4$ are an oxygen atom, a sulfur atom or a selenium atom; $Z_5$, $Z_6$, $Z_7$ and $Z_8$ are each a hydrogen atom, a halogen atom, a hydroxy group, an alkoxy group, an amino group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group, $Z_5$ and $Z_6$, and/or $Z_7$ and $Z_8$ are allowed to be bonded with each other to form a ring; $X_2+$ is an anion; and n is an integer of 1 or 2, and n is 1 when an intramolecular salt is formed;

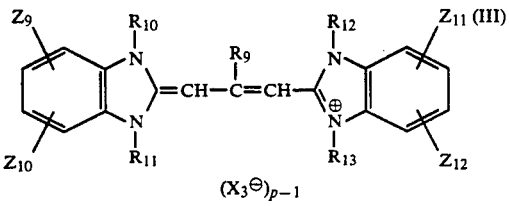

wherein $R_9$ is a hydrogen atom, an alkyl group or an aryl group; $R_{10}$, $R_{11}$, $R_{12}$ and $R_{13}$ are each an alkyl group; $Z_9$, $Z_{10}$, $Z_{11}$ and $Z_{12}$ are each a hydrogen atom, a halogen atom, a hydroxy group, an alkoxy group, an amino group, an acyl group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group, $Z_9$ and $Z_{10}$, and/or $Z_{11}$ and $Z_{12}$ are allowed to be bonded with each other to form a ring; $X_3+$ is an anion; and p is an integer of 1 or 2, and p is 1 when an intramolecular salt is formed, said red-sensitive emulsion layer contains a cyan coupler represented by formula CU;

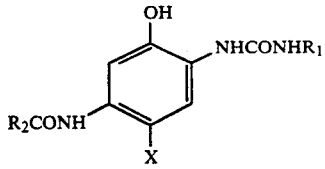

(CU)

wherein X is a hydrogen atom or a substituent capable of splitting off upon reaction with oxydation product of a primary amine color developing agent; $R_1$ is aryl or a heterocyclic; $R_2$ is an aliphatic or an aryl group, and said high speed red sensitive silver halide emulsion sublayer contains a diffusible DIR compound having a diffusibility of not less than 0.40.

* * * * *